US008478150B2

(12) United States Patent
Fujihara et al.

(10) Patent No.: US 8,478,150 B2
(45) Date of Patent: Jul. 2, 2013

(54) IMAGE FORMING APPARATUS AND METHOD FOR CONTROLLING SAME

(75) Inventors: Kensuke Fujihara, Osaka (JP); Tamotsu Shimizu, Osaka (JP); Ryota Maeda, Osaka (JP); Koji Fujii, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 894 days.

(21) Appl. No.: 12/606,291

(22) Filed: Oct. 27, 2009

(65) Prior Publication Data

US 2010/0111551 A1 May 6, 2010

(30) Foreign Application Priority Data

Nov. 6, 2008 (JP) ..... 2008-285318

(51) Int. Cl.
*G03G 15/06* (2006.01)

(52) U.S. Cl.
USPC ..... 399/55; 399/56; 399/270; 399/271; 399/272; 399/279; 399/285; 430/122.8

(58) Field of Classification Search
USPC ..... 399/26, 31, 55, 285; 430/122.8
See application file for complete search history.

(56) References Cited

U.S. PATENT DOCUMENTS

| | | | | |
|---|---|---|---|---|
| 5,521,683 | A * | 5/1996 | Miyamoto et al. | 399/55 |
| 6,266,494 | B1 * | 7/2001 | Budnik et al. | 399/55 |
| 6,445,889 | B1 * | 9/2002 | Leclerc et al. | 399/53 |
| 6,845,220 | B2 * | 1/2005 | Lee | 399/38 |
| 7,043,181 | B2 * | 5/2006 | Fujishima et al. | 399/279 |
| 7,979,011 | B2 * | 7/2011 | Fujihara et al. | 399/270 |
| 8,116,647 | B2 * | 2/2012 | Fujihara et al. | 399/55 |
| 2004/0018025 | A1 * | 1/2004 | Park et al. | 399/55 |
| 2004/0052540 | A1 * | 3/2004 | Kyung | 399/55 |
| 2008/0232863 | A1 * | 9/2008 | Saiki | 399/285 |
| 2009/0245886 | A1 * | 10/2009 | Sakata | 399/270 |
| 2010/0054820 | A1 * | 3/2010 | Fujihara et al. | 399/270 |
| 2010/0129102 | A1 * | 5/2010 | Fujihara et al. | 399/55 |

FOREIGN PATENT DOCUMENTS

JP 3815356 6/2006

OTHER PUBLICATIONS

English machine translation of Japanese patent document JP 2003-287942 A; by Yaoi, Yoshiko; Shimazoe, Makato; and Nakagawa, Shuichi; Original Japanese Document Published Oct. 10, 2003.*

* cited by examiner

*Primary Examiner* — David Gray
*Assistant Examiner* — Geoffrey Evans
(74) *Attorney, Agent, or Firm* — Smith, Gambrell & Russell, LLP

(57) ABSTRACT

An image forming apparatus has: a photoconductive drum that rotates; a developing roller that carries toner to be charged and to which a first voltage application portion outputting an AC voltage is connected; a contact member that makes contact with the photoconductive drum to remove residual toner; a detection portion for detecting occurrence of electric discharge between the developing roller and the photoconductive drum; and a developing unit that feeds toner to the developing roller, that supports the developing roller opposite the photoconductive drum with a gap secured in between, and that feeds toner to the developing roller with prescribed timing and for a prescribed time during electric discharge detection.

18 Claims, 10 Drawing Sheets

IMAGE FORMING APPARATUS AND METHOD FOR CONTROLLING SAME

This application is based on Japanese Patent Application No. 2008-285318 filed on Nov. 6, 2008, the contents of which are hereby incorporated by reference.

BACKGROUND OF THE INVENTION

1. Field of the Invention

The present invention relates to image forming apparatuses such as multi-function printers (MFPs), copiers, printers, and facsimile machines.

2. Description of Related Art

Conventionally, in some image forming apparatuses using toner, such as multi-function printers, copiers, printers, and facsimile machines, there are arranged a photoconductive drum and, opposite it with a gap in between, a developing roller. To the developing roller, a so-called developing bias is applied that has a direct current (DC) and an alternating current (AC) superimposed on each other. As a result, charged toner flies from the developing roller to the photoconductive drum, and thereby an electrostatic latent image is developed. The toner image thus developed is transferred onto and fixed to a sheet, and thereby printing is achieved.

Here, to feed sufficient toner to the photoconductive drum, to obtain desired density in the image formed, and to enhance development efficiency, the peal-to-peak voltage of the AC voltage applied to the developing roller may be increased; however, if it is increased too far, electric discharge occurs between the photoconductive drum and the developing roller. When electric discharge occurs, due to a potential change on the surface of the photoconductive drum, the static latent image is disturbed, and the quality of the image formed is deteriorated. The photoconductive drum can have a property such that, depending on the direction in which the discharge current flows, a large current may flow through the photoconductive drum. When a large current flows, the photoconductive drum may suffer damage, such as a minute hole (pinhole) developing in it. Accordingly, the peak-to-peak voltage may be increased, but within the range in which no electric discharge occurs.

Thus, there is conventionally known a developing unit provided with an image carrying member and, opposite it at a desired interval in the development region, a toner carrying member, wherein a developing bias voltage having a DC voltage and an AC voltage superimposed on each other is applied between the toner carrying member and the image carrying member so that toner is fed to the image carrying member to develop an electrostatic latent image, there are provided a leak generating means for varying a leak detection voltage applied between the image carrying member and the toner carrying member and a leak detecting means for detecting leakage, wherein, as the maximum potential difference $\Delta V_{max}$ between the leak detecting voltage and the surface potential of the image carrying member is increased, when the current flowing between the image carrying member and the toner carrying member increases continuously, the leak detecting means recognizes leakage.

Here, as a big factor that determines the potential difference at which electric discharge occurs, the gap length between the developing roller and the photoconductive drum differs from one image forming apparatus to another due to errors in the fitting and arrangement of the photoconductive drum and the developing roller, variations from the ideal shapes of the photoconductive drum and the developing roller, etc. Moreover, the potential difference at which electric discharge occurs varies under the influence of the atmospheric pressure etc. Accordingly, while the magnitude of the AC voltage applied to the developing roller is varied, the discharge start voltage (the peak-to-peak voltage at which electric discharge starts) is detected. Thereafter, based on the peak-to-peak voltage of the AC voltage at the time of detection of electric discharge, the potential difference between the developing roller and the photoconductive drum at which electric discharge starts is grasped. Then, the AC voltage applied to the developing roller is determined such that, at the time of printing, it is slightly lower than that potential difference.

When electric discharge is detected, however, if toner is carried on the developing roller, since toner is insulating, since the thickness of the toner layer changes the gap length, and for other reasons, the peak-to-peak voltage at which electric discharge starts becomes unstable. In other words, every time it is detected and measured, the discharge start voltage varies. Furthermore, the developing roller carries toner to be charged, and, when the charged toner moves from the developing roller to the photoconductive drum, electric charge moves (a current occurs). Thus, distinction from minute electric discharge is difficult, and "electric discharge" may be erroneously recognized to "have occurred."

As described above, when occurrence of electric discharge is detected with toner carried on the developing roller, many inconveniences result. There also is a problem in precision, accuracy, etc. Accordingly, occurrence of electric discharge may be detected without toner carried on the developing roller; however, when no toner is carried on the developing roller during detection of electric discharge, no toner is fed to the photoconductive drum. Here, the photoconductive drum and the developing roller have, for reasons of manufacture, deviations (variations) from their ideal shapes. Accordingly, so that a state with a shortened gap length may appear, they are rotated during detection of electric discharge. Furthermore, for removal of residual toner on the photoconductive drum, a contact member such as a blade may be provided.

During detection of electric discharge, if no toner is fed to the photoconductive drum at all, no replacement of toner occurs; thus the toner at a tip part of the contact member making contact with the photoconductive drum keeps being rubbed against the photoconductive drum, and the potential may keep rising. If detection of electric discharge lasts long, the potential of the toner may become extremely high, and dielectric breakdown such as electric discharge or leakage may result. When such dielectric breakdown occurs, the photoconductive drum may suffer damage, such as a pinhole, that may lead to a shorter lifetime and degraded image quality, which is a problem.

Incidentally, in some conventional developing units, no member, such as a blade, making contact with the photoconductive drum is used; in some others, during detection of electric discharge (leakage), the photoconductive drum does not rotate; in still some others, whether or not to carry toner on the toner carrying member cannot be controlled. In view of these (facts), it is clear that the above-mentioned problems cannot be solved in conventional developing units.

SUMMARY OF THE INVENTION

In view of the above-mentioned problems experienced with the conventional technology, an object of the present invention is to achieve the following at the time of detection of electric discharge: stabilization of the voltage at which electric discharge occurs, without toner being carried on the developing roller all the time; and prevention of an excessive rise in the toner potential between a contacting member and the photoconductive drum through supply of toner to the developing roller and the photoconductive drum with given timing with a view to replacing the toner rubbed against the photoconductive drum.

To achieve the above object, according to the invention, an image forming apparatus is provided with: a photoconductive drum that is rotatably supported and that rotates by receiving a drive force from a drive source; a developing roller that carries toner to be charged, that is connected to a first voltage application portion outputting an AC voltage, and that feeds toner to the photoconductive drum; a contact member that makes contact with the photoconductive drum to remove residual toner; a detection portion that detects occurrence of electric discharge between the developing roller and the photoconductive drum; and a developing unit that feeds toner to the developing roller, and that supports the developing roller opposite the photoconductive drum with a gap secured in between, the developing unit feeding toner to the developing roller with prescribed timing and for a prescribed time during electric discharge detection in which, while the photoconductive drum rotates and the first voltage application portion stepwise varies a peak-to-peak voltage of an AC voltage applied to the developing roller, a voltage at which electric discharge occurs between the photoconductive drum and the developing roller occurs is detected.

This makes it possible to prevent a friction-induced excessive rise in the potential of the toner between the photoconductive drum and the contact member. It should be noted that the "prescribed time" may be any quantity of time so long as it permits replacement of the toner at the part of the contact member making contact with the photoconductive drum.

Further features and advantages of the present invention will become apparent from the description of embodiments given below.

DETAILED DESCRIPTION OF PREFERRED EMBODIMENTS

An embodiment of the present invention will be described below with reference to FIGS. 1 to 10. In this embodiment, an electrophotographic, tandem-type color printer 1 (corresponding to an image forming apparatus) will be taken up as an example for description. It should be understood, however, that none of the features in respect of construction, arrangement, etc., that are given in connection with the embodiment is meant to limit the scope of the invention in any way, that is, those features are simply examples for the sake of description.

Outline Construction of Image Forming Apparatus

Figure 1:
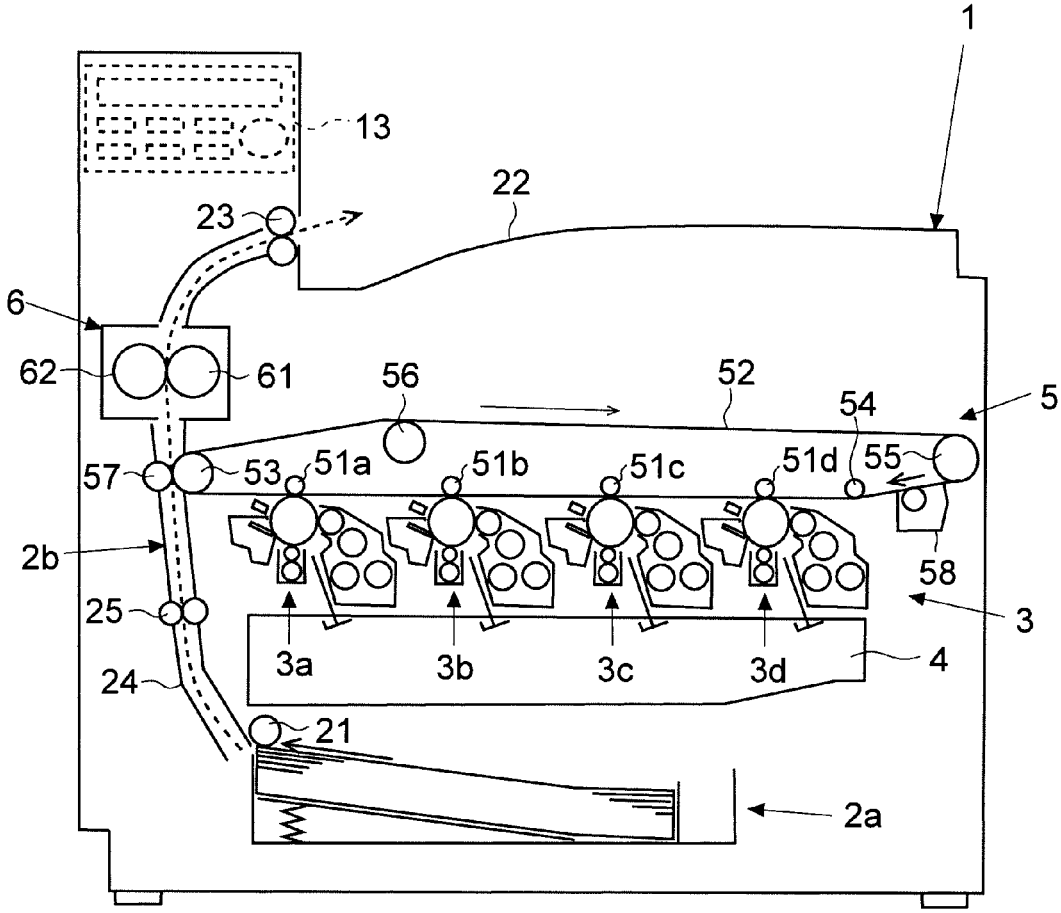
FIG. 1 is a sectional view showing an outline of the construction of a printer according to an embodiment of the invention.
Figure 2:
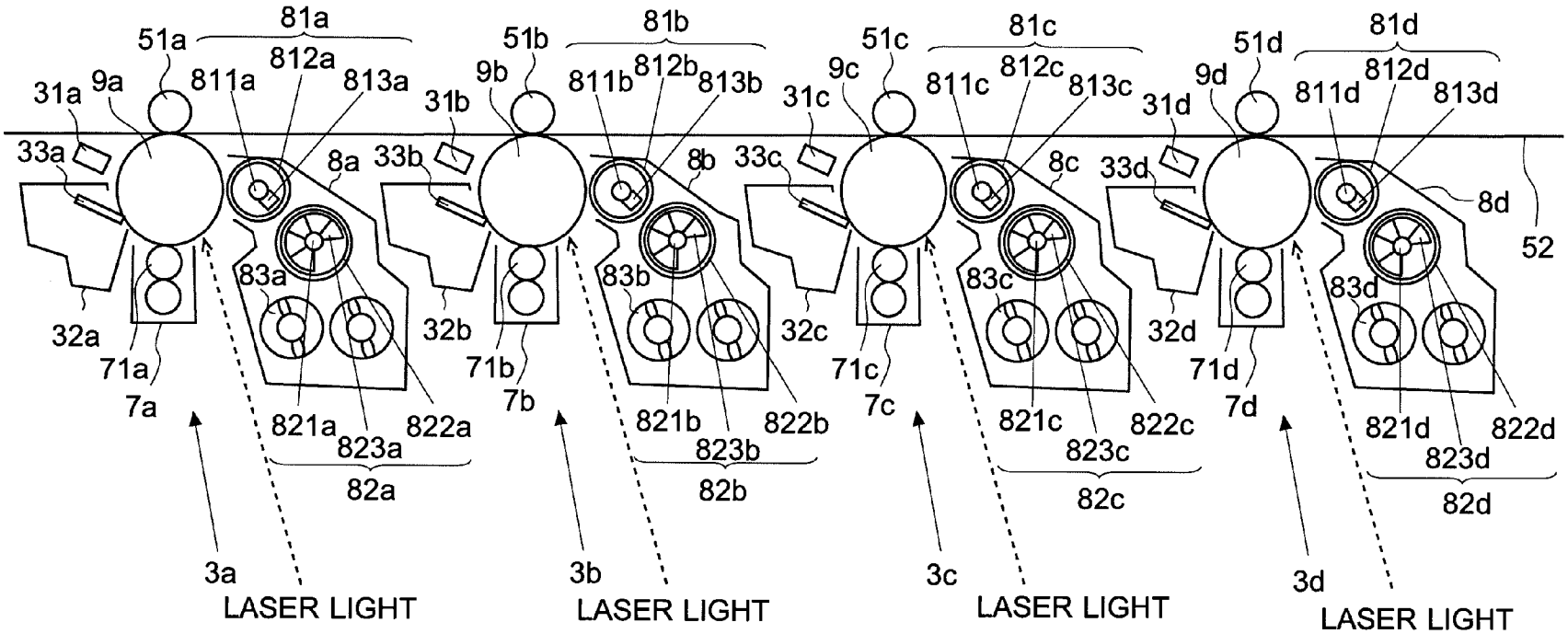
FIG. 2 is an enlarged sectional view of individual image formation portions according to the embodiment.

The invention finds applications in image forming apparatuses such as multi-function printers and copiers. In the following description, a printer 1 will be taken up as an example of an image forming apparatus for description purposes. First, with reference to FIGS. 1 and 2, an outline of the printer 1 according to the embodiment will be described. FIG. 1 is a sectional view showing an outline of the construction of the printer 1 according to the embodiment of the invention. FIG. 2 is an enlarged sectional view of individual image formation portions 3 according to the embodiment of the invention. As shown in FIG. 1, the printer 1 according to the embodiment is provided with, inside a cabinet, a sheet feed portion 2*a*, a transport passage 2*b*, an image formation portion 3, an exposing unit 4, an intermediate transfer portion 5, a fixing unit 6, etc.

The sheet feed portion 2*a* accommodates sheets of different types, such as copying paper sheets, OHP (overhead projector) sheets, and label paper sheets, to name a few. The sheet feed portion 2*a* feeds the sheets out into the transport passage 2*b* by a paper feed roller 21 rotated by a drive mechanism (unillustrated) such as a motor. Through the transport passage 2*b*, the sheets are transported inside the printer 1. The transport passage 2*b* guides the sheets fed from the sheet feed portion 2*a* via the intermediate transfer portion 5 and the fixing unit 6 to an ejection tray 22. The transport passage 2*b* is provided with a pair of transfer rollers 23 and guides 24. The transport passage 2*b* is also provided with, among others, a pair of resist rollers 25 that keeps the sheets transported to it in a stand-by state in front of the intermediate transfer portion 5 before feeding them out with proper timing.

As shown in FIGS. 1 and 2, the printer 1 is provided with, as a part that forms a toner image based on image data of an image to be formed, image formation portions 3 for four colors. Specifically, the printer 1 is provided with an image formation portion 3*a* that forms a black image (including a charging unit 7*a*, a developing unit 8*a*, a charge eliminating unit 31*a*, a cleaning unit 32*a*, etc.), an image formation portion 3*b* that forms a yellow image (including a charging unit 7*b*, a developing unit 8*b*, a charge eliminating unit 31*b*, a cleaning unit 32*b*, etc.), an image formation portion 3*c* that forms a cyan image (including a charging unit 7*c*, a developing unit 8*c*, a charge eliminating unit 31*c*, a cleaning unit 32*c*, etc.), and an image formation portion 3*d* that forms a magenta image (including a charging unit 7*d*, a developing unit 8*d*, a charge eliminating unit 31*d*, a cleaning unit 32*d*, etc.).

Now, with reference to FIG. 2, the image formation portions 3*a* to 3*d* will be described in detail. The image formation portions 3*a* to 3*d* differ among themselves only in the color of the toner image they form, and have basically a similar construction. Accordingly, in the following description, the letters a, b, c, and d for distinguishing which of the image formation portions 3 to belong to will be omitted unless necessary (in FIG. 2, the components of one of the image formation portions 3*a*, 3*b*, 3*c*, and 3*d* are distinguished from those of the others by reference signs having one of the letters a, b, c, and d added to them).

Each photoconductive drum 9 is rotatably supported, and is driven, by receiving a driving force from a motor M (see FIG. 4), to rotate at a predetermined speed counter-clockwise as seen on the plane of the figure. Each photoconductive drum 9 carries a toner image on its peripheral surface. Each photoconductive drum 9 has a photoconductive layer or the like of amorphous silicon or the like on the outer peripheral surface of a drum, as a base member, formed of aluminum. In this embodiment, each photoconductive drum 9 is of a positive-charging type.

Each charging unit 7 has a charging roller 71, and charges the corresponding photoconductive drum 9 with a given electric charge. Each charging roller 71 makes contact with the corresponding photoconductive drum 9, and rotates together with it. To each charging roller 71, a charge voltage application portion 72 (see FIG. 4) applies a voltage having a direct current (DC) and an alternating current (AC) superimposed on each other. This causes the surface of the photoconductive drum 9 to be charged uniformly to a predetermined positive potential (e.g., 200 V to 300 V, the dark potential). The charging unit 7 may instead be of a corona-discharge type, or may be one that charges the photoconductive drum 9 by use of a brush or the like.

Each developing unit 8 accommodates a developer containing toner and a magnetic carrier (a so-called two-component developer). The developing unit 8*a* accommodates a black developer, the developing unit 8*b* accommodates a yellow developer, the developing unit 8*c* accommodates a cyan developer, and the developing unit 8*d* accommodates a magenta developer. Each developing unit 8 includes a developing roller 81, a magnetic roller 82 (corresponding to a rotating member), and a carrying member 83. Each developing unit 8 supports the developing roller 81 with a gap from, and opposite, the corresponding photoconductive drum 9, and feeds toner to the developing roller 81. Each developing roller 81 is arranged opposite, and with a predetermined gap (e.g., 1 mm or less) from, the photoconductive drum 9. The developing roller 81 carries toner to be charged, and, with an AC voltage application portion 86 (see FIG. 3) that outputs an AC voltage connected to it, feeds the toner to the photoconductive drum 9.

Each magnetic roller 82 is located opposite the corresponding developing roller 81. Each magnetic roller 82 is connected to a magnetic roller 82 bias application portion 84 (see FIG. 3; corresponding to a second voltage application portion). Under application of a voltage from the magnetic roller bias application portion 84, each magnetic roller 82 feeds toner to the developing roller 81. The magnetic roller 82 is arranged to the lower right of the developing roller 81, with a predetermined gap (e.g., 1 mm to several millimeters) from it. Each carrying member 83 is arranged below the corresponding magnetic roller 82.

Each developing roller 81 and each magnetic roller 82 have their respective roller shafts 811 and 821 fixedly supported. The roller shafts 811 and 821 inside each developing roller 81 and each magnetic roller 82 are fitted with magnets 813 and 823, respectively, that extend in the axial direction. Each developing roller 81 and each magnetic roller 82 have cylindrical sleeves 812 and 822, respectively, that cover the magnets 813 and 823. At the time of printing and at the time of detecting electric discharge, an unillustrated drive mechanism rotates these sleeves 812 and 822 (see FIG. 3). At positions on the developing roller 81 and the magnetic roller 82 opposite each other, the opposite poles of the magnet 813 of the developing roller 81 and the magnet 823 of the magnetic roller 82 face each other.

Thus, between each developing roller 81 and the corresponding magnetic roller 82, the magnetic carrier forms a magnetic brush. Rotation of the magnetic brush and of the sleeve 822 of the magnetic roller 82, application of a voltage to the magnetic roller 82 (the magnetic roller bias application portion 84; see FIG. 4), etc. cause toner to be fed to the developing roller 81. As a result, a thin layer of toner is formed on the developing roller 81. The toner that remains after development is attracted off the developing roller 81 by the magnetic brush. Each carrying member 83 has a screw formed in the shape of a spiral around the axis. Each carrying member 83 transports and agitates the developer inside the corresponding developing unit 8. As a result, friction between the toner and the carrier causes the toner to be charged (in this embodiment, the toner is charged positively).

Each cleaning unit 32 cleans the corresponding photoconductive drum 9. Each cleaning unit 32 has a blade 33 (corresponding to a contact member) that extends in the axial direction of the photoconductive drum 9, has the shape of a flat plate, and is formed of, for example, resin. Each blade 33 makes contact with the photoconductive drum 9, and scrapes off and removes dirt such as residual toner after transfer. Above each cleaning unit 32, a charge eliminating unit 31 (e.g., arrayed LEDs) is provided that irradiates the photoconductive drum 9 with light to eliminate electric charge from it.

The exposing unit 4 below the image formation portions 3 outputs laser light in the form of optical signals respectively obtained through conversion of color-separated image signals fed to it. The exposing unit 4 scans with and exposes to the laser light the charged photoconductive drum 9 to form an electrostatic latent image.

For example, the exposing unit 4 is provided with, inside it, a semiconductor laser device (laser diode), a polygon mirror, a polygon motor, an fθ lens, a mirror (unillustrated), etc. So constructed, the exposing unit 4 irradiates the photoconductive drums 9 with laser light. As a result, electrostatic latent images according to the image data are formed on the photoconductive drums 9. Specifically, in this embodiment, the photoconductive drums 9 are all charged positively. Accordingly, at their parts exposed to light, the potential falls (e.g., to about 0 V), and positively charged toner attaches to the parts where the potential has fallen. For example, in the case of a solid filled image, all the lines and all the pixels are irradiated with laser light. As the exposing unit 4, for example, one composed of a large number of LEDs may be used.

Figure 5:
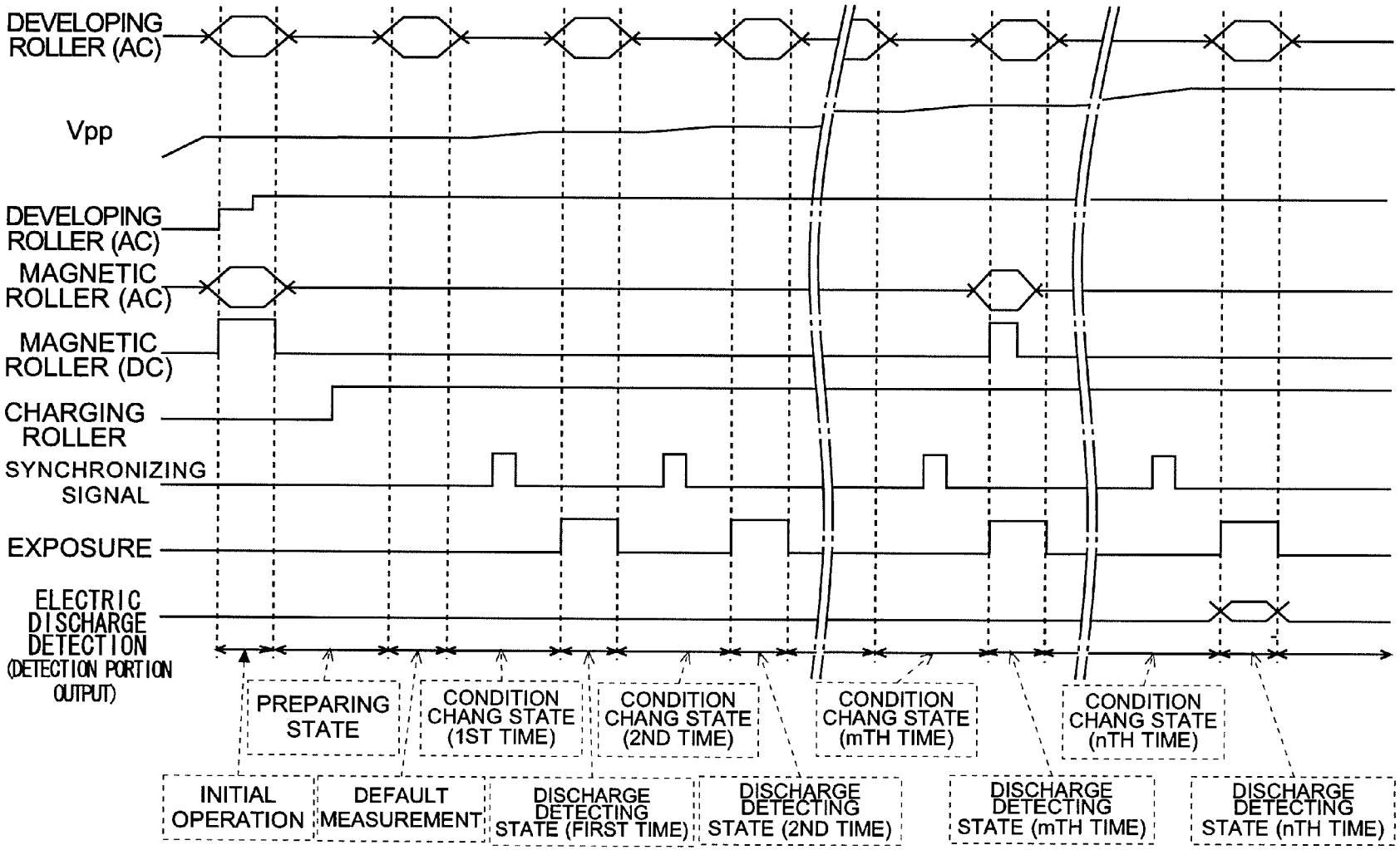
FIG. 5 is a timing chart illustrating an outline of electric discharge detection according to the embodiment.

In the exposing unit 4, a light-receiving element (unillustrated) is provided within the range irradiated with laser light but outside the range in which the photoconductive drum 9 is irradiated. When irradiated with laser light, the light-receiving element outputs an electric current (voltage). This output is fed to, for example, a CPU (central processing unit) 11, which will be described later. The CPU 11 uses this as a synchronizing signal at the time of detection of whether or not electric discharge is occurring (FIG. 5).

The description will now continue with reference back to FIG. 1. The intermediate transfer portion 5 receives primary transfer of toner images from the photoconductive drums 9, and performs secondary transfer onto a sheet. The intermediate transfer portion 5 is composed of primary transfer rollers 51*a* to 51*d*, an intermediate transfer belt 52, a driving roller 53, following rollers 54, 55, and 56, a secondary transfer roller 57, a belt cleaning unit 58, etc. The intermediate transfer belt 52, which is endless, is nipped between the primary transfer rollers 51*a* to 51*d* and the corresponding photoconductive drums 9. Each primary transfer roller 51 is connected to a transfer voltage application portion (unillustrated) that applies a transfer voltage, and transfers a toner image onto the intermediate transfer belt 52.

The intermediate transfer belt 52 is formed of a dielectric resin or the like, and is wound around the driving roller 53, the following rollers 54, 55, and 56, and all the primary transfer rollers 51. As the driving roller 53, which is connected to a drive mechanism (unillustrated) such as a motor, is driven to rotate, the intermediate transfer belt 52 rotates clockwise as seen on the plane of the figure. The intermediate transfer belt 52 is nipped between the driving roller 53 and the secondary transfer roller 57, and thus a nip (secondary transfer portion) is formed.

To transfer the toner images, first, a predetermined voltage is applied to the primary transfer rollers 51. The toner images (black, yellow, cyan, and magenta respectively) formed in the image formation portions 3 are primary-transferred onto the intermediate transfer belt 52 such that one image is superimposed on the next with no deviation. The resulting toner image thus having the different colors superimposed on one another is then transferred onto a sheet by the secondary transfer roller 57 having a predetermined voltage applied to it. Residual toner and the like remaining on the intermediate transfer belt 52 after secondary transfer is removed and collected by the belt cleaning unit 58 (see FIG. 1).

The fixing unit 6 is disposed on the downstream side of the secondary transfer portion with respect to the sheet transport direction. The fixing unit 6 heats and presses the secondary-transferred toner image to fix it on the sheet. The fixing unit 6 is composed mainly of a fixing roller 61, which incorporates a heat source, and a pressing roller 62, which is pressed against the fixing roller 61. Between the fixing roller 61 and the pressing roller 62, a nip is formed. As the sheet having the toner image transferred onto it passes between the nip, it is heated and pressed. As a result, the toner image is fixed to the sheet. The sheet after fixing is ejected into the ejection tray 22, and this completes image formation processing.

Configuration for Electric Discharge Detection

Figure 3:
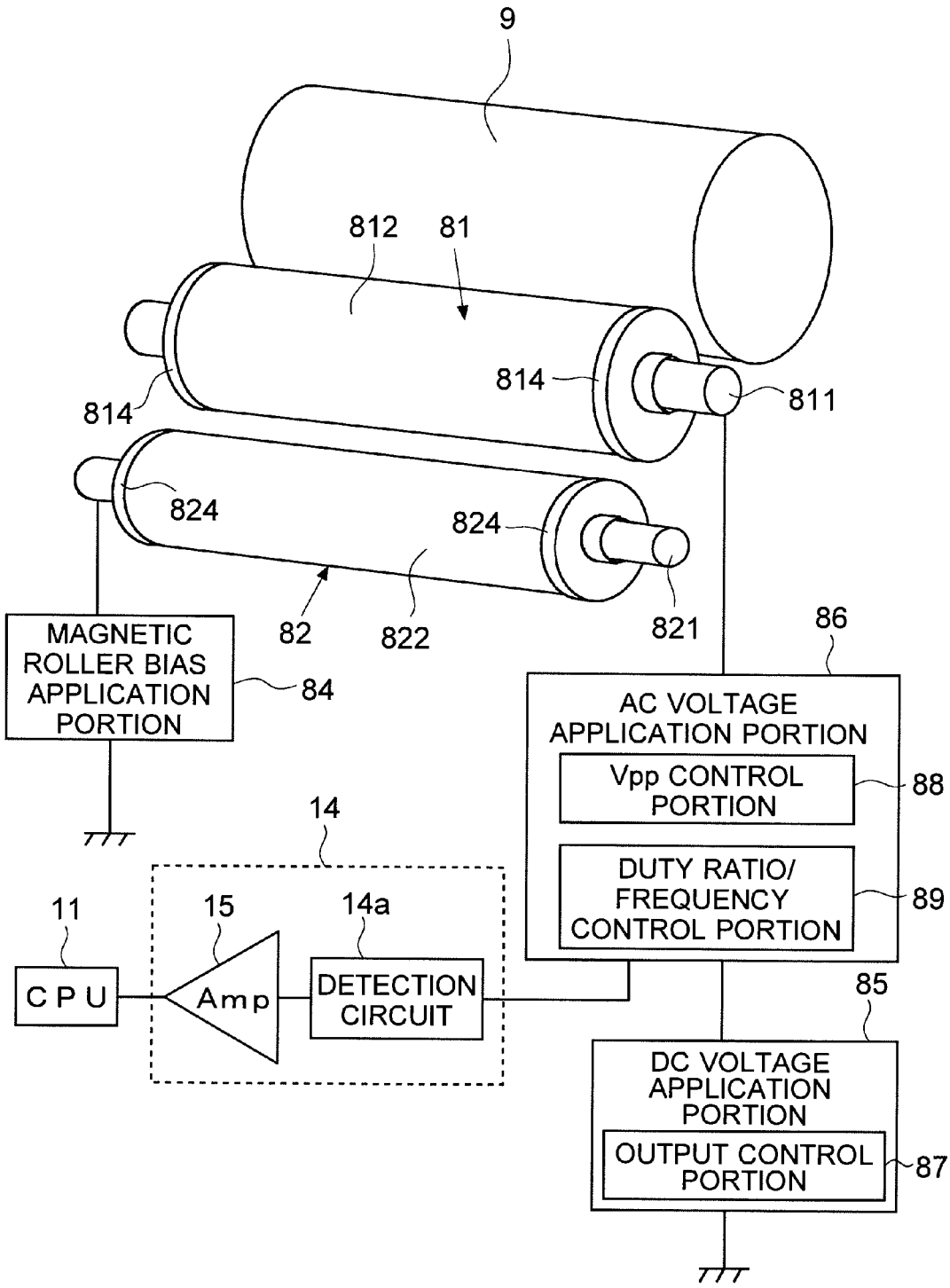
FIG. 3 is a diagram illustrating the configuration related to electric discharge detection according to the embodiment.

Next, with reference to FIG. 3, the configuration related to detection of electric charge will be described. FIG. 3 is a diagram illustrating the configuration related to electric charge detection according to the embodiment of the invention.

It should be noted that FIG. 3 shows the configuration only with respect to one image formation portion 3. Specifically, for each image formation portion 3, there are provided a DC voltage application portion 85, an AC voltage application portion 86 (corresponding to a first voltage application portion), a detection portion 14, an amplifier (Amp) 15, etc. The output of each amplifier 15 is then fed to the CPU 11 in a control portion 10, which will be described later. Here, the DC voltage application portion 85, the AC voltage application portion 86, the detection portion 14, the amplifier 15, etc. may be identified by reference signs having one of the letters a, b, c, and d added to them to distinguish among the different image formation portions 3, but since these are each provided with components similar among them, for the sake of simplicity, the following description will dispense with the letters a, b, c, and d.

As shown in FIG. 3, the developing roller 81 is located opposite the photoconductive drum 9 with a gap between them. The developing roller 81 has a roller shaft 811, caps 814, and a sleeve 812 that carries toner. The roller shaft 811 has the sleeve 812 put around it. The caps 814, which are circular, are fit into both ends of the sleeve 812. To the roller shaft 811 of the developing roller 81, the DC voltage application portion 85 and the AC voltage application portion 86 are connected for the feeding of toner to the photoconductive drum 9.

The DC voltage application portion 85 is a circuit that generates a DC component to be applied to the developing roller 81. The output of the DC voltage application portion 85 is fed to the AC voltage application portion 86. The DC voltage application portion 85 has an output control portion 87. According to an instruction from the CPU 11, the output control portion 87 controls the value of a bias that the DC voltage application portion 85 outputs.

The DC voltage application portion 85 is supplied with DC electric power from a power supply 16 (see FIG. 4) within the printer 1. The DC voltage application portion 85 is a circuit whose output voltage is variable under the control of the output control portion 87 according to an instruction from the CPU 11. The DC voltage application portion 85 may be, for example, a DC-DC converter. The DC voltage application portion 85 may be, for example, one that has a plurality of paths leading to output ends for different output voltages and switches among them between at the time of image formation and at the time of electric discharge detection. Thus, the AC voltage applied to the developing roller 81 is biased.

The AC voltage application portion 86 is a circuit that outputs an AC voltage that has a rectangular (pulsating) waveform and whose average value equals the DC voltage that the DC voltage application portion 85 outputs. The AC voltage application portion 86 has a Vpp control portion 88 and a duty ratio/frequency control portion 89. The Vpp control portion 88 controls the peak-to-peak voltage of the AC voltage according to an instruction from the CPU 11. The duty ratio/frequency control portion 89 controls the duty ratio and frequency of the AC voltage according to an instruction from the CPU 11.

For example, the AC voltage application portion 86 is a power supply circuit provided with a plurality of switching devices. For example, the AC voltage application portion 86 reverses the polarity of its output (whether it is positive or negative) by switching, to output an AC voltage. The duty ratio/frequency control portion 89 can control the duty ratio and frequency of the AC voltage by, for example, controlling the timing with which the polarity of the output of the AC voltage application portion 86 is switched.

Figure 4:
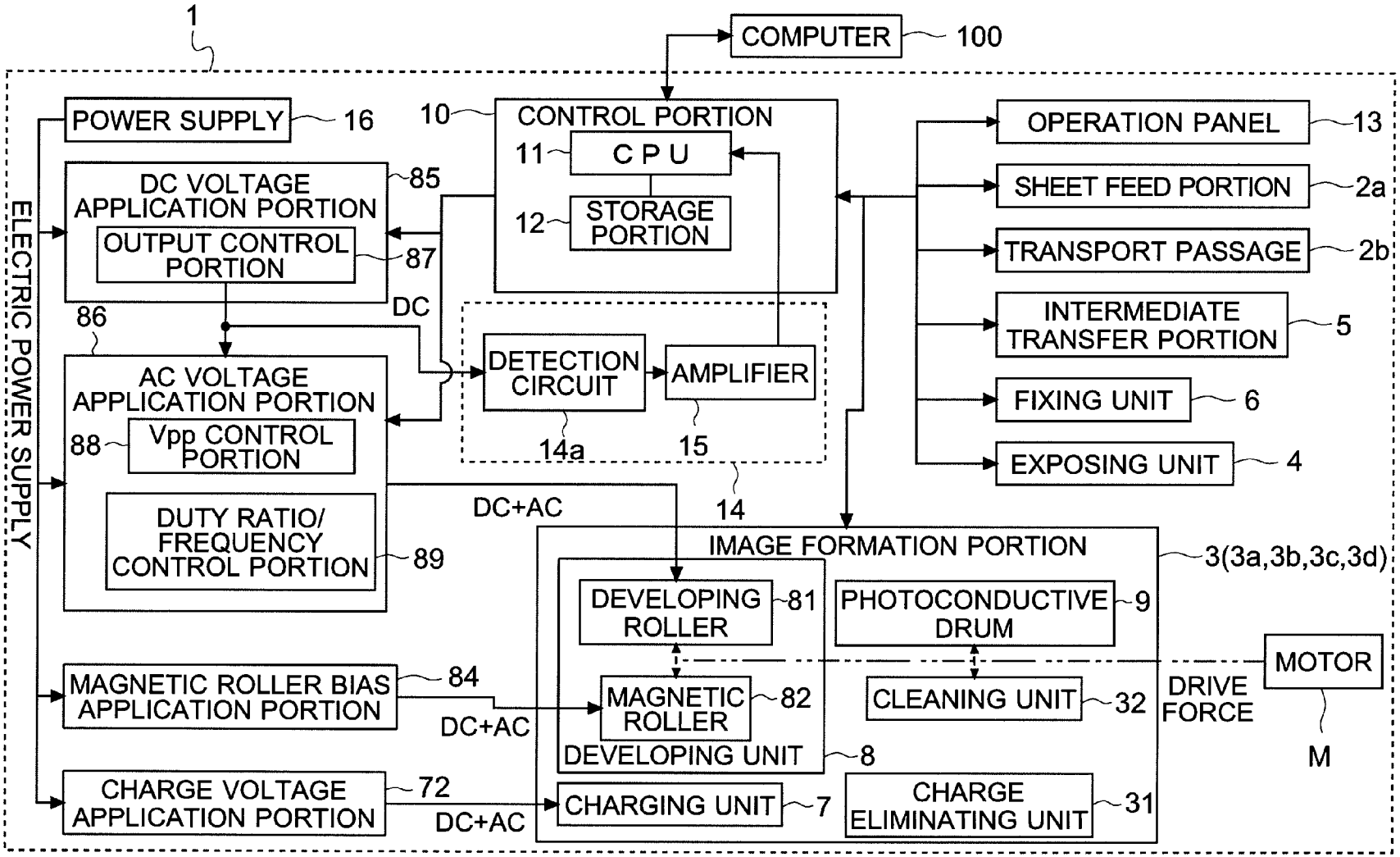
FIG. 4 is a block diagram showing an example of the hardware configuration of the printer according to the embodiment.

According to an instruction from the CPU 11, and based on the peak-to-peak voltage and duty ratio of the AC voltage to be applied to the developing roller 81, the Vpp control portion 88 steps up, steps down, or otherwise adapts the DC voltage fed from the power supply 16 (see FIG. 4). The Vpp control portion 88 also varies the positive- and negative-side peak values of the AC voltage. Any configuration may be adopted for the AC voltage application portion 86, and for varying the peak-to-peak voltage, duty ratio, and frequency of the AC voltage, so long as the peak-to-peak voltage, duty ratio, and frequency can be varied.

The AC voltage application portion 86 is provided with, inside it, for example, a step-up circuit employing a step-up transformer. Thus, a developing bias having the direct current from the DC voltage application portion 85 and the stepped-up AC voltage superimposed on each other is applied to, for example, the roller shaft 811 of the developing roller 81. In this way, a developing bias is applied to the sleeve 812 as well. As a result, the charged toner carried on the sleeve 812 flies.

The detection portion 14 is a circuit for detecting occurrence of electric discharge between the developing roller 81 and the photoconductive drum 9. The detection portion 14 is composed of a detection circuit 14*a* and an amplifier 15. The detection circuit 14*a* converts the current (discharge current) flowing on occurrence of electric discharge into a voltage signal, and thereby detects occurrence of electric discharge. For example, the detection circuit 14*a* compares, with a voltage obtained by converting by use of resistors or the like the current flowing through the developing roller 81 when no electric discharge is occurring, a voltage obtained by converting the current flowing through the developing roller 81 when electric discharge is occurring. The detection circuit 14*a* outputs the difference between the two voltages to the amplifier 15. The amplifier 15 amplifies the voltage signal from the detection circuit 14*a* and outputs the result to the CPU 11. The CPU 11 performs A/D conversion on the voltage signal from the amplifier 15. Based on the A/D-converted output of the amplifier 15, the CPU 11 can recognize occurrence of electric discharge and the magnitude of the electric discharge occurred (the magnitude of the current that has flowed between the developing roller 81 and the photoconductive drum 9).

Next, the configuration for applying a voltage to the magnetic roller 82 will be described. As described above, the magnetic roller 82 is arranged opposite the developing roller 81 with a predetermined gap in between (where a magnetic brush is formed) and with their axial directions aligned parallel to each other. The magnetic roller 82 has a roller shaft 821, a sleeve 822 that carries toner and a carrier, and caps 824. The roller shaft 821 has the sleeve 822 put around it. The caps 824, which are circular, are fit into both ends of the sleeve 822.

The magnetic roller bias application portion 84 is connected to the roller shaft 821 of the magnetic roller 82. The magnetic roller bias application portion 84 applies to the magnetic roller 82 a voltage (magnetic roller bias) having a DC voltage and an AC voltage superimposed on each other. As a result of application of the magnetic roller bias by the magnetic roller bias application portion 84, charged toner moves to the developing roller 81 by an electrostatic force. As a result, toner is fed to the developing roller 81. The magnetic roller bias application portion 84 may be a combination of the AC voltage application portion 86 and the DC voltage application portion 85 both described above. The magnetic roller bias, however, does not need to be varied in multiple steps in terms of its peak-to-peak voltage etc. as the developing bias is for detection of electric discharge detection and for enhancement of development efficiency. Accordingly, the magnetic roller bias application portion 84 may be one that outputs one or several prescribed voltages.

In the printer 1 according to the embodiment, the photoconductive drum 9 used has a photoconductive layer of amorphous silicon, which is charged positively. This photoconductive drum 9 has the property that the higher the potential of the developing roller 81 when electric discharge occurs, the less likely a large current flows through the photoconductive drum 9. Accordingly, to avoid damage to the photoconductive drum 9 due to a large current, the duty ratio and frequency are so adjusted that electric discharge occurs with the developing roller 81 at a high potential (the details will be given later). Thus, the discharge current only flows from the developing roller 81 to the photoconductive drum 9. Accordingly, the charge current appears as a variation in the DC voltage applied to the developing roller 81. The detection portion 14 thus has only to check for a variation in the DC voltage to the developing roller 81.

Hardware Configuration of Printer 1

Next, with reference to FIG. 4, the hardware configuration of the printer 1 according to the embodiment of the invention will be described. FIG. 4 is a block diagram showing an example of the hardware configuration of the printer 1 according to the embodiment of the invention.

As shown in FIG. 4, the printer 1 according to the embodiment has a control portion 10 inside it. The control portion 10 controls different parts of the printer 1. The control portion 10 also recognizes occurrence of electric discharge by receiving the output of the detection portion 14 (amplifier 15). For example, the control portion 10 is composed of a CPU 11, a storage portion 12, etc. The CPU 11 is a central processing unit, and engages in computation and in the control of different parts of the CPU 11 based on a control program stored and mapped in the storage portion 12. The storage portion 12 is composed of a combination of nonvolatile and volatile storage devices, such as ROM, RAM, and flash ROM. For example, the storage portion 12 stores control programs, control data, etc. for the printer 1. In this invention, programs for detecting electric discharge and for setting the voltages applied to the developing roller 81 and the magnetic roller 82 are also stored in the storage portion 12.

The control portion 10 is connected to the sheet feed portion 2*a*, the transport passage 2*b*, the image formation portion 3, the exposing unit 4, the intermediate transfer portion 5, the fixing unit 6, an operation panel 13, etc, and controls the operation of different parts according to control programs and data in the storage portion 12 so that image formation is performed properly. The control portion 10 is connected to a motor M (corresponding to a drive source) that supplies a drive force for rotating the photoconductive drums 9, the developing rollers 81, the magnetic rollers 82, etc. in the image formation portions 3. At the time of printing and at the time of electric discharge detection, the control portion 10 drives the motor M to rotate the photoconductive drums 9 etc. just mentioned. By driving the motor M, the control portion 10 can also rotate the sleeves of the developing rollers 81 and the magnetic rollers 82.

The operation panel 13 is provided in a top front part of the printer 1, and it has a liquid crystal panel to display various kinds of setting information, warnings, etc. The operation panel 13 also has various operation buttons to accept user operation. To the control portion 10, a computer 100 (such as a personal computer) is connected that serves as the source from which image data to be printed is transmitted. The control portion 10 subjects the received image data to image processing. The exposing unit 4 receives the image data, and forms an electrostatic latent image on the photoconductive drums 9. The charge voltage application portion 72 is a circuit that applies a voltage for charging to the charging rollers 71.

In this invention, to the control portion 10 (CPU 11), the detection portion 14 (amplifier 15) is connected. At the time of detection of electric discharge, the CPU 11 feeds the AC voltage application portion 86 with instructions to vary stepwise the peak-to-peak voltage etc. of the AC voltage applied to the developing roller 81. Based on the output of the detection portion 14 (amplifier 15), the CPU 11 detects whether electric discharge is occurring and recognizes the magnitude of electric discharge.

Electric Discharge Detection Operation and Setting of AC Voltage Applied to Developing Roller 81

Figure 6:
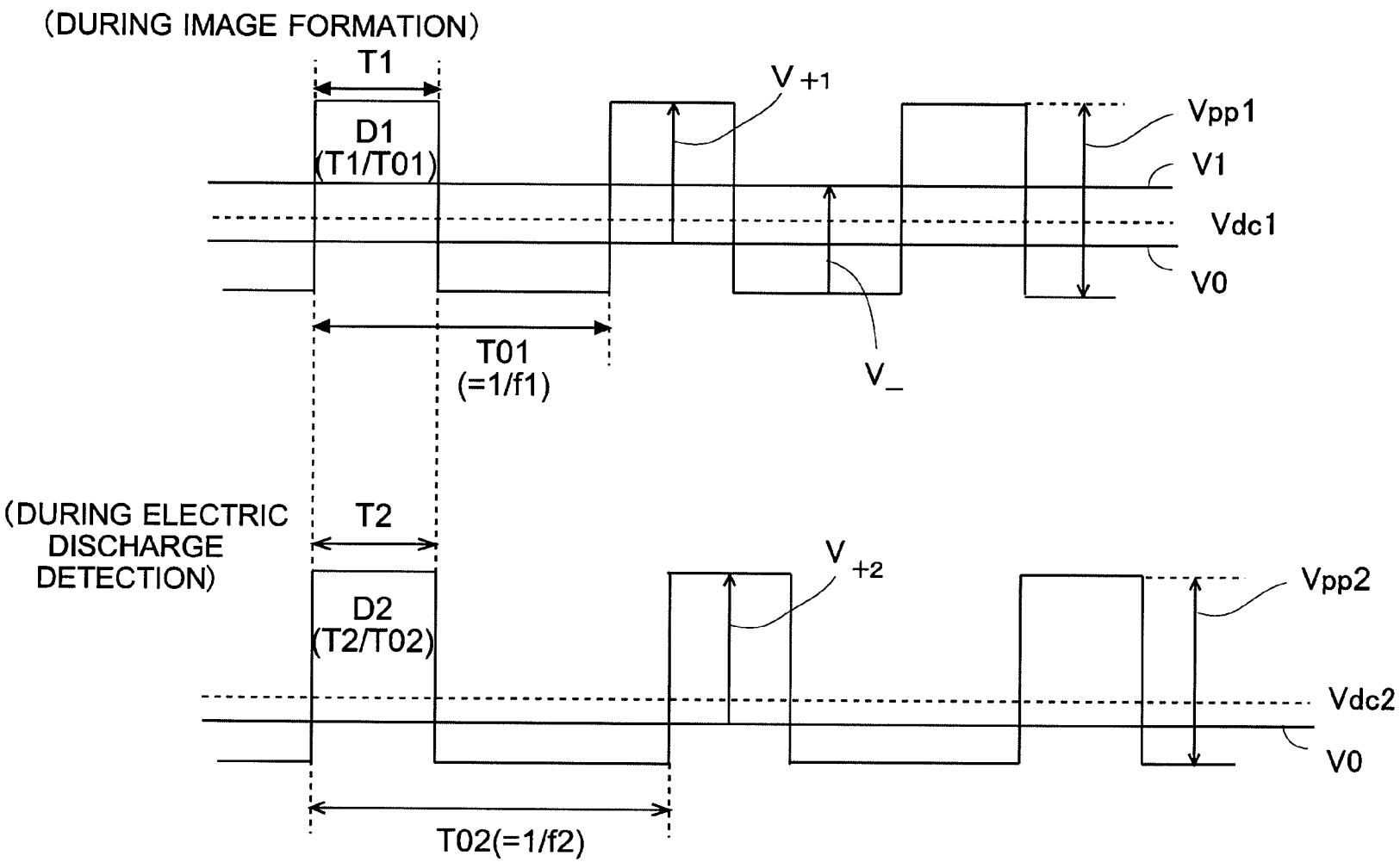
FIG. 6 is a timing chart showing an example of the AC voltage applied to the developing roller according to the embodiment.

Next, with reference to timing charts in FIGS. 5 and 6, an example of operation for detecting occurrence of electric discharge between the photoconductive drum 9 and the developing roller 81 will be described. FIG. 5 is a timing chart illustrating an outline of electric discharge detection according to the embodiment of the invention. FIG. 6 is a timing chart showing an example of the AC voltage applied to the developing roller 81 according to the embodiment of the invention. In this invention, the purpose of detecting electric discharge is to search for the peak-to-peak voltage at which electric discharge starts. This electric discharge detection is performed for each image formation portion 3, one at a time.

First, in FIG. 5, "DEVELOPING ROLLER (AC)" indicates the timing with which the AC voltage application portion 86 applies an AC voltage to the developing roller 81. "Vpp" indicates the variation of the magnitude of the peak-to-peak voltage of the AC voltage to the developing roller 81. "DEVELOPING ROLLER (DC)" indicates the timing with which the DC voltage application portion 85 applies a DC voltage to the developing roller 81. "MAGNETIC ROLLER (AC)" indicates the timing with which the magnetic roller bias application portion 84 (see FIG. 4) applies an AC voltage to the magnetic roller 82. "MAGNETIC ROLLER (DC)" indicates the timing with which the magnetic roller bias portion applies a DC voltage to the magnetic roller 82.

"CHARGING ROLLER" indicates the timing with which the charging unit 7 charges the photoconductive drum 9. "SYNCHRONIZING SIGNAL" indicates the synchronizing signal that the light-receiving element of the exposing unit 4 outputs. "EXPOSURE" indicates the timing with which the photoconductive drum 9 is exposed (irradiated with laser light) in the exposing unit 4. "ELECTRIC DISCHARGE DETECTION (DETECTION PORTION OUTPUT)" indicates the timing with which the detection portion 14 detects electric discharge.

Initial Operation: When electric discharge detection according to the invention is started, first, initial operation is performed. In the initial operation, first, the photoconductive drum 9, the developing roller 81, the intermediate transfer belt 52, etc. start to rotate, and then, in the initial operation, an AC voltage and a DC voltage are applied to the developing roller 81 and the magnetic roller 82 respectively. As a result of this application of the voltage to the magnetic roller 82 in the initial operation, a small amount of toner is fed from the magnetic roller 82 to the developing roller 81. After this initial operation, a transition is made to a preparation state.

Preparation State and Default Measurement: In the preparation state, the charging unit 7 starts to charge the photoconductive drum 9. It should be noted that, until completion of the operation for detecting the peak-to-peak voltage at which electric discharge starts, the voltage applied to the charging unit 7 is kept on. Moreover, the peak-to-peak voltage of the AC voltage applied to the developing roller 81 is raised to the peak-to-peak voltage for default measurement. It should be noted that the peak-to-peak voltage of the AC voltage applied to the developing roller 81 in the default measurement is set at, for example, its minimum settable value. Next, a transition is made to the default measurement, in which the control portion 10 checks whether or not electric discharge is occurring. The default measurement is for checking whether or not electric discharge occurs in a state in which no electric discharge is supposed to occur, and is performed to detect an abnormality in the fitting position of components, such as the detection portion 14, in the circuits, etc. After the default measurement, a transition is made to a condition change state (for the 1st time).

Condition Change State: In the condition change state, the peak-to-peak voltage of the AC voltage applied to the developing roller 81 is varied (e.g., raised) in steps. In the middle of the condition change state, the synchronizing signal, based on which to start the exposure of the exposing unit 4, turns high. After the synchronizing signal turns high, a transition is made to a discharge detection state (for the 1st time).

Discharge Detection State: In the discharge detection state, a developing bias is applied to the developing roller 81. Moreover, the exposing unit 4 continues exposure (exposure of the entire surface of the photoconductive drum 9; the surface potential of the photoconductive drum 9 is stabilized at about 0V). In the printer 1 according to the embodiment, the charging polarity of both the toner and the photoconductive drum 9 is positive, and accordingly toner attaches to exposed parts; thus continuous exposure is equivalent to formation of an electrostatic latent image of a solid filled image. Accordingly, in the discharge detection state, image data of a solid filled image is fed, for example, from the control portion 10 to the exposing unit 4 (e.g., the storage portion 12 stores image data of a solid filled image).

The discharge detection state lasts for a given length of time (e.g., 0.5 to several seconds). Based on the input from the amplifier 15 to the CPU 11, in a given case, such as when no electric discharge is detected, the control portion 10 effects a transition to the condition change state. In the condition change state, the control portion 10 again instructs the AC voltage application portion 86 to issue an instruction to change the peak-to-peak voltage of the AC voltage. As a result, in the next and any following discharge detection states, whether or not electric discharge is occurring is checked basically with a higher-than-last-time peak-to-peak voltage in the AC voltage applied to the developing roller 81. In other words, until the AC voltage at which electric discharge occurs is identified, the condition change state and the discharge detection state are repeated. During the repetition, the peak-to-peak voltage of the AC voltage applied to the developing roller 81 increases in given step widths. FIG. 5 shows a case where electric discharge is detected in the n-th time discharge detection state.

Next, with reference to FIG. 6, the application of the voltage to the developing roller 81 in the discharge detection state will be described. FIG. 6 shows, in its upper part, a timing chart at the time of printing and, in its lower part, a timing chart at the time of electric discharge detection.

First, the rectangular wave in the timing chart at the time of image formation (printing) is an example of the waveform of the developing bias (AC+DC) applied to the developing roller 81. "Vdc1" indicates the potential of the bias of the DC voltage application portion 85. "V0" indicates the potential (approximately 0 V, which is the light potential) of the photoconductive drum 9 after exposure by the exposing unit 4. "V1" indicates the potential of the photoconductive drum 9 after charging (the potential of the parts that are not exposed; e.g., about 200 to 300 V). "$V_{+1}$" indicates the potential difference between V0 and the positive peak value of the development bias at the time of printing. "$V_{-1}$" indicates the potential difference between V1 and the negative peak value of the development bias. "Vpp1" indicates the peak-to-peak voltage of the AC voltage applied to the developing roller 81 at the time of printing. "T1" indicates the period in which the rectangular wave is high (positive). "T01" indicates the cycle of the rectangular wave.

On the other hand, the rectangular wave in the timing chart at the time of electric discharge detection represents the waveform of the development bias applied to the developing roller 81. "Vdc2" indicates the potential of the bias of the DC voltage application portion 85 at the time of detection. "V0" indicates, as in the upper part of FIG. 5, the potential (approximately 0 V) of the photoconductive drum 9 after exposure by the exposing unit 4. "$V_{+2}$" indicates the potential difference between the positive peak value of the development bias at the time of detection and V0. "Vpp2" indicates the peak-to-peak voltage of the AC voltage applied to the developing roller 81.

"T2" indicates the period in which the rectangular wave is high (positive). "T02" indicates the cycle of the rectangular wave.

First, at the time of electric discharge detection, under an instruction from the control portion 10, the output control portion 87 sets the output of the DC voltage application portion 85 at the set value Vdc2 for electric discharge detection (e.g., 100 V to 200 V). Moreover, under an instruction from the control portion 10, the Vpp control portion 88 sets the AC voltage Vpp2 that the AC voltage application portion 86 outputs (it should be noted that Vpp2 changes its value every new condition change state). Moreover, under an instruction from the control portion 10, the duty ratio/frequency control portion 89 sets, at a set value for electric discharge detection, the duty ratio D2 (the ratio of the high period T2 to the cycle T02, i.e., T2/T02) of the AC voltage that the AC voltage application portion 86 outputs. Moreover, the duty ratio/frequency control portion 89 sets, at a set value for electric discharge detection, the frequency f2 (=1/T02) of the AC voltage that the AC voltage application portion 86 outputs (the lower part of FIG. 6).

Here, the duty ratio D2 is set lower than the duty ratio D1 at the time of printing (the ratio of the high period T1 to the cycle T01, i.e., T1/T01) (e.g., D1=40% and D2=30%). The photoconductive drum 9 according to the embodiment has the property (a diode-like property) that a large current flows through it if electric discharge occurs when the potential of the developing roller 81 is low (at the negative peak); accordingly, the duty ratio D2 is so set that the negative peak voltage has as small an absolute value as possible. This allows electric discharge to occur between the developing roller 81 and the photoconductive drum 9 with the potential of the developing roller 81 higher than that of the photoconductive drum 9. The frequency f2 is so set that the period in which the AC voltage is positive is equal between at the time of printing and at the time of electric discharge detection (i.e., T1=T2; e.g., when D1=40% and D2=30%, and in addition f1=4 kHz, then f2=3 kHz). Thus, for the same period as at the time of printing, the positive voltage is applied to the developing roller 81.

Problem Arising During Electric Discharge Detection

Figure 7:
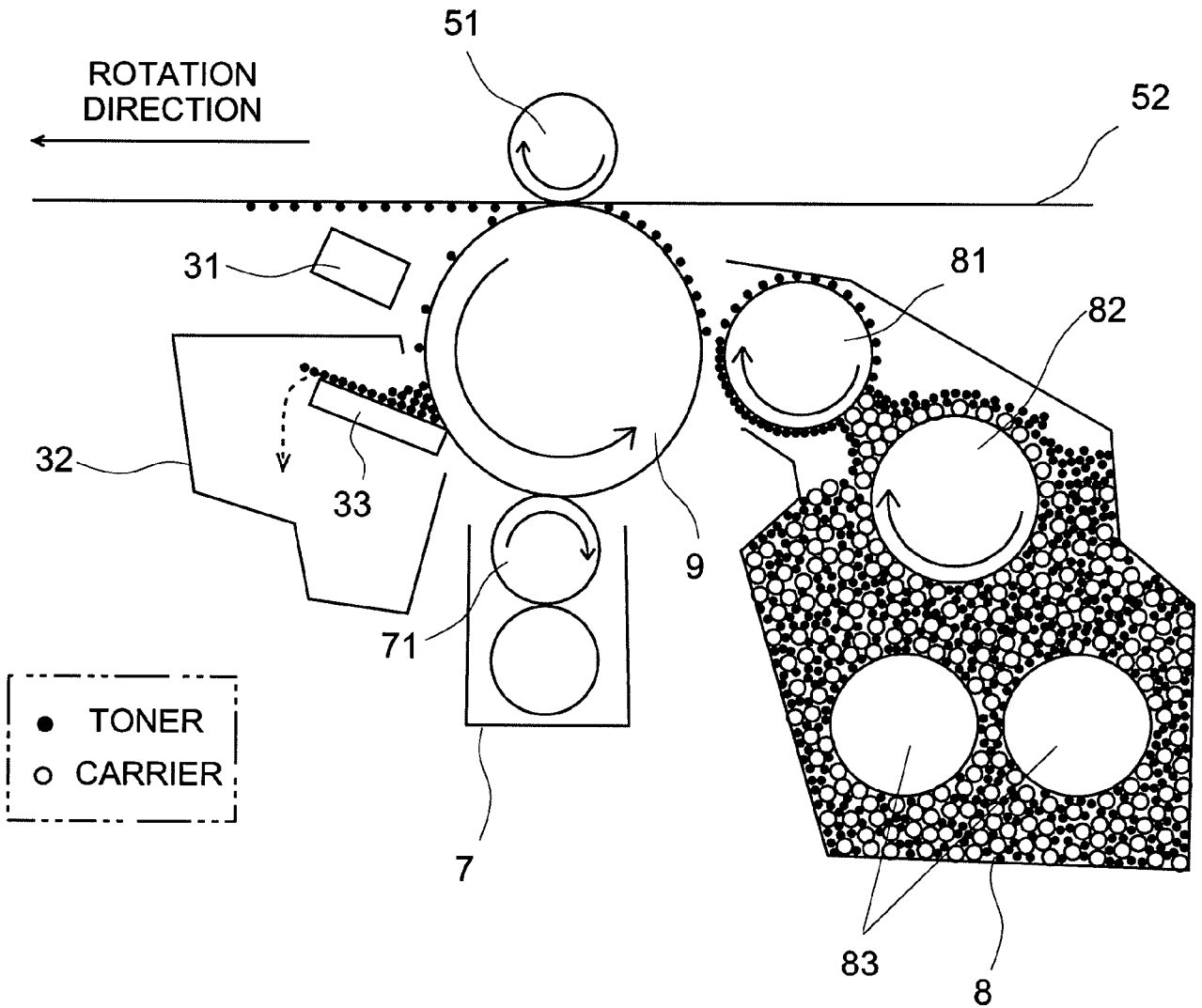
FIG. 7 is a schematic diagram for illustration of a problem experienced during electric discharge detection according to the embodiment.
Figure 8B:
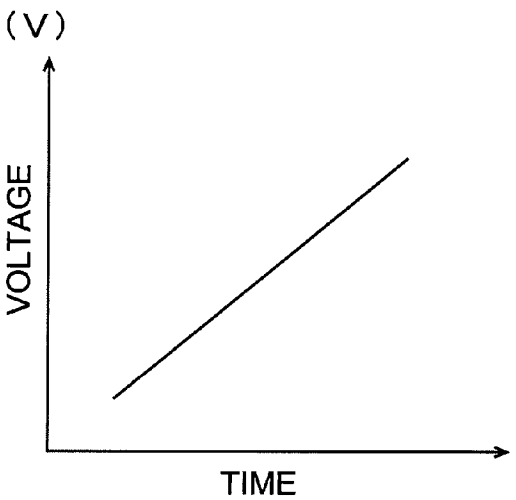
FIG. 8B is a graph showing an example of the relationship with time of the potential of toner that keeps being rubbed against the photoconductive drum.
Figure 8A:
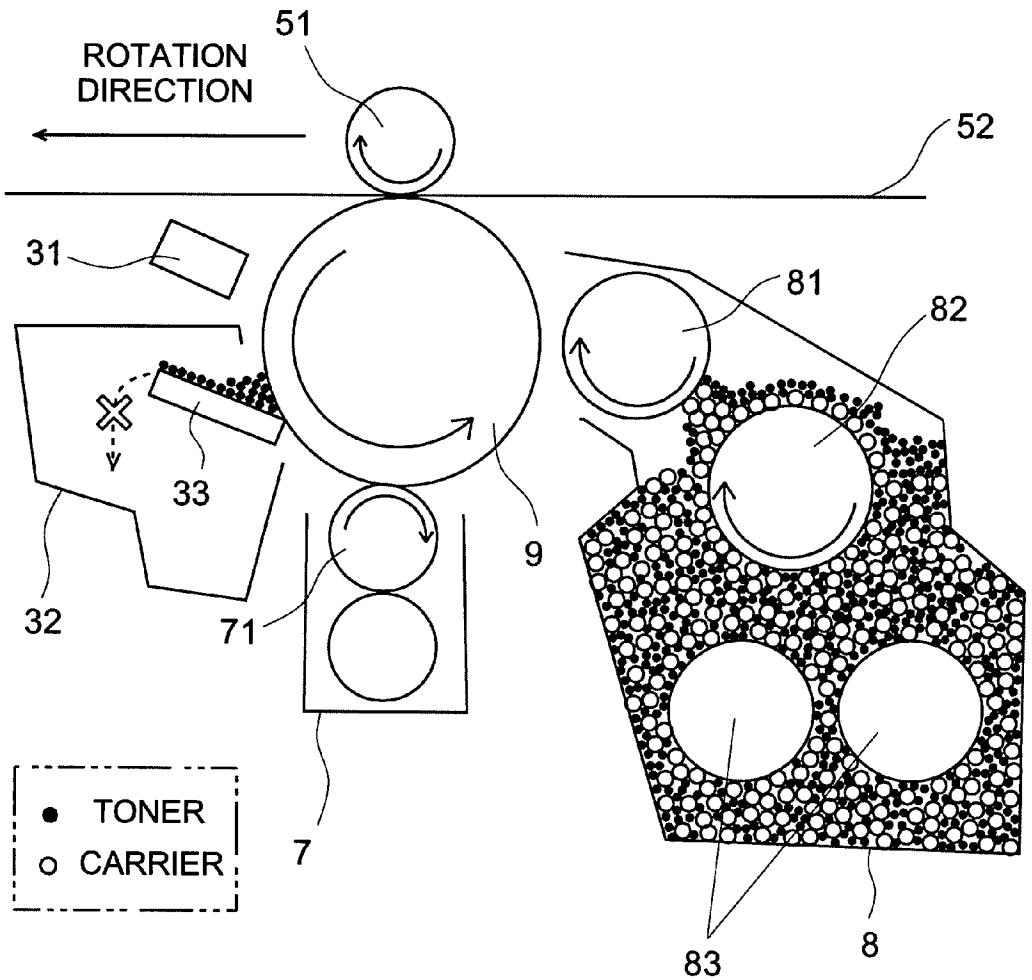
FIG. 8A is a schematic diagram for illustration of a problem experienced during electric discharge detection according to the embodiment.

Next, with reference to FIGS. 7, 8A, and 8B, a problem arising at the time of electric discharge detection according to the embodiment of the invention will be described. FIGS. 7 and 8A are schematic diagrams illustrating a problem arising at the time of electric discharge detection according to the embodiment of the invention, and FIG. 8B is a graph showing an example of the relationship with time of the potential of toner that keeps being rubbed against the photoconductive drum 9. In FIGS. 7 and 8A, solid black dots ("●") represent toner (for convenience' sake, the particle diameters are exaggerated; the same is true with the carrier), and hollow circles ("○") represent carrier.

First, with reference to FIG. 7, the movement of toner and the cleaning of the photoconductive drum 9 at the time of printing will be described. As shown in FIG. 7, the developing unit 8 accommodates, inside it, a developer containing toner and a magnetic carrier. The developing unit 8 agitates the developer by the carrying member 83. As a result, the toner is charged. Moreover, at the time of printing, the sleeve 812 of the developing roller 81, the sleeve 822 of the magnetic roller 82, and the photoconductive drum 9 rotates. Moreover, by the magnetic brush formed between the developing roller 81 and the magnetic roller 82, through the application of the magnetic roller bias, etc., the toner is fed to the developing roller 81 (a thin layer of toner is formed). Furthermore, the application of the development bias causes the toner to fly from the developing roller 81 to the photoconductive drum 9. The photoconductive drum 9 continues to rotate, so that, as the residual toner—the toner left untransferred—reaches near the cleaning unit 32, it is scraped off by the blade 33.

At the time of printing, toner continues to be fed to the photoconductive drum 9. The blade 33 continuously scrapes off the residual toner. Through this continuous scraping-off, the toner that has been scraped off previously is pushed gradually inward of the cleaning unit 32. As indicated by a broken-line arrow in FIG. 7, it eventually falls off the blade 33. In this way, during printing, the toner scraped off moves from near the photoconductive drum 9 toward the inside of the cleaning unit 32 and is collected.

Next, with reference to FIGS. 7 and 8A, the reason that toner is basically not carried on the developing roller 81 at the time of electric discharge detection will be described. As shown in FIG. 8A, in the printer according to the embodiment, at the time of electric discharge detection, the magnetic roller 82 basically does not receive application of the magnetic roller bias (see FIG. 5). Accordingly, the developing roller 81 basically does not carry toner at the time of electric discharge detection (no toner is fed to the photoconductive drum 9 either).

Here, if toner is carried on the developing roller 81 at the time of electric discharge detection, the thickness of the layer of toner formed on the developing roller 81 changes the gap length between the developing roller 81 and the photoconductive drum 9. On the other hand, toner is generally insulating. These factors combine to produce the inconvenience that carrying toner on the developing roller 81 destabilize the peak-to-peak voltage at which electric discharge of the development bias starts. In other words, every time electric discharge detection is performed, the peak-to-peak voltage at which electric discharge of the development bias starts (the discharge start voltage) changes.

Moreover, since toner is charged, movement of toner from the developing roller 81 to the photoconductive drum 9 means movement of electric charge; that is, a current flows. This movement of electric charge ascribable to toner may be detected by the detection portion 14. This causes no problem where the target of detection is an electric discharge far larger than a current resulting from movement of toner. In the printer according to the embodiment, however, detection of electric discharge is performed to give the development bias as high a peak-to-peak voltage within the range in which no electric discharge occurs.

That is, in the printer according to the embodiment, electric discharge detection is for detecting the discharge start voltage, and its target is minute electric discharge. Accordingly, distinction from a current resulting from movement of toner may be difficult. Thus, a current resulting from movement of toner may be erroneously detected as occurrence of electric discharge. Furthermore, if toner is carried on the developing roller 81 at the time of electric discharge detection, inconveniently, the longer it takes until electric discharge occurs, the more toner is consumed. With consideration given to these inconveniences, in the printer according to the embodiment, at the time of electric discharge detection, toner is basically not carried on the developing roller 81.

If no toner is carried on the developing roller 81 at the time of electric discharge detection, the above inconveniences are overcome, but another problem arises. This will now be described with reference to FIGS. 8A and 8B. FIG. 8A shows a case where no toner is carried on the developing roller 81 at the time of electric discharge detection (the magnetic roller bias is not applied continuously).

When no toner is carried on the developing roller 81, there is almost no toner for the blade 33 to scrape off newly.

Accordingly, in the cleaning unit 32, the residual toner that has previously been scraped off remains at the blade 33. This same toner thus continues to be in contact with the photoconductive drum 9. On the other hand, at the time of electric discharge detection, the photoconductive drum 9 continues to rotate. Thus, at a tip part of the blade 33 (where the blade 33 makes contact with the photoconductive drum 9), the same toner keeps being rubbed against the photoconductive drum 9.

Here, the toner becomes charged by friction. Thus, as shown in FIG. 8B, at the tip part of the blade 33, the potential of the toner that keeps being rubbed against the photoconductive drum 9 rises with time. It should be understood that, although FIG. 8B shows, as an extreme example, a case where the potential of the toner rises linearly—as a linear function, how the potential rises is not so limited. When the potential (electrostatic potential) of the toner rises too far, electric discharge or the like occurs from the toner. This may cause a large current to flow through the photoconductive layer of the photoconductive drum 9.

Such a current that flows due to an excessive rise in toner potential may cause damage to the photoconductive drum 9, such as by making a hole in the photoconductive drum 9 (development of a pinhole). For example, if a pinhole develops, even when the photoconductive drum 9 is charged, the pinholed part is not charged; moreover, the electric charge around the pinhole flows, which degrades the quality of the image formed.

To overcome the inconveniences that arise as a result of no toner being carried on the developing roller at the time of electric discharge detection, in the printer according to the embodiment, as shown in FIG. 5, when electric discharge detection is started, and also when a predetermined time has passed after the magnetic roller bias previously started being applied (in FIG. 5, illustrated as DISCHARGE DETECTION STATE (mTH TIME)), the magnetic roller bias is intentionally applied for a prescribed time to feed toner to the developing roller 81 and the photoconductive drum 9. That is, the prescribed timing with which toner is fed to the developing roller 81 at the time of electric discharge detection is when electric discharge detection is started and when a predetermined time has elapsed after completion of previous feeding of toner to the developing roller 81 of the developing unit 8.

Before the potential of the toner at the blade 33 rises too far, through application of the magnetic roller bias at the time of electric discharge detection, toner is fed to the photoconductive drum 9. The blade 33 thus scrapes off the newly fed toner. In this way, the toner that has kept being rubbed against the photoconductive drum 9 is replaced.

Now, the "predetermined time" will be described. The time that the toner potential takes to rise so high as to cause dielectric breakdown varies according to factors such as the charging properties of toner and the rotation speed of the photoconductive drum 9. Accordingly, for each model of image forming apparatus, through experiments or the like, the time that the potential of the toner at the tip part of the blade 33 takes to rise so high as to cause dialectic breakdown is identified, and a time shorter than the thus identified time is taken as the predetermined time. For example, the predetermined time is determined, for example, in a range of several tens of seconds to several minutes (e.g., 30 seconds to 1 minute).

On the other hand, the "prescribed time" can be freely determined with consideration given to the rotation speed of the individual sleeves, the toner feeding ability of the developing roller 81 and the magnetic roller 82, etc. Applying the magnetic roller bias for too long a time, however, may lead to inconveniences such as an unstable peak-to-peak voltage in the development bias at which electric discharge occurs. Accordingly, the "prescribed time" can be determined in a range of about 0.1 to 1.0 second so long as the quantity is such that the toner at the part of the contact member making contact with the photoconductive drum can be replaced. FIG. 5 shows an example in which, for the mth time, the magnetic roller bias is applied during electric discharge detection with a shorter magnetic roller bias application time than when electric discharge detection operation is started.

Flow of Control for Electric Discharge Detection

Figure 9:
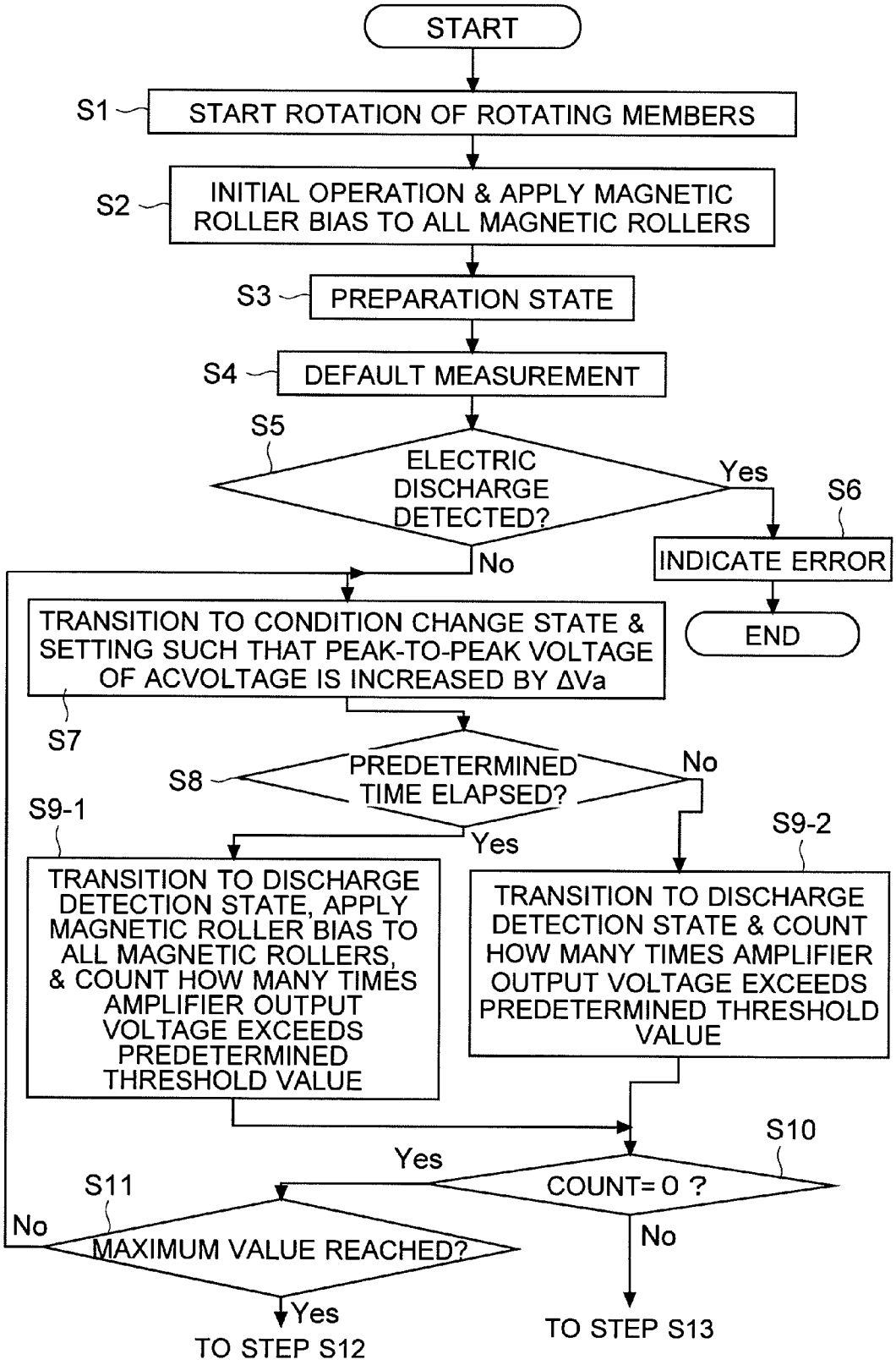
FIG. 9 is a flow chart showing an example of the flow of control for electric discharge detection operation in the printer according to the embodiment.
Figure 10:
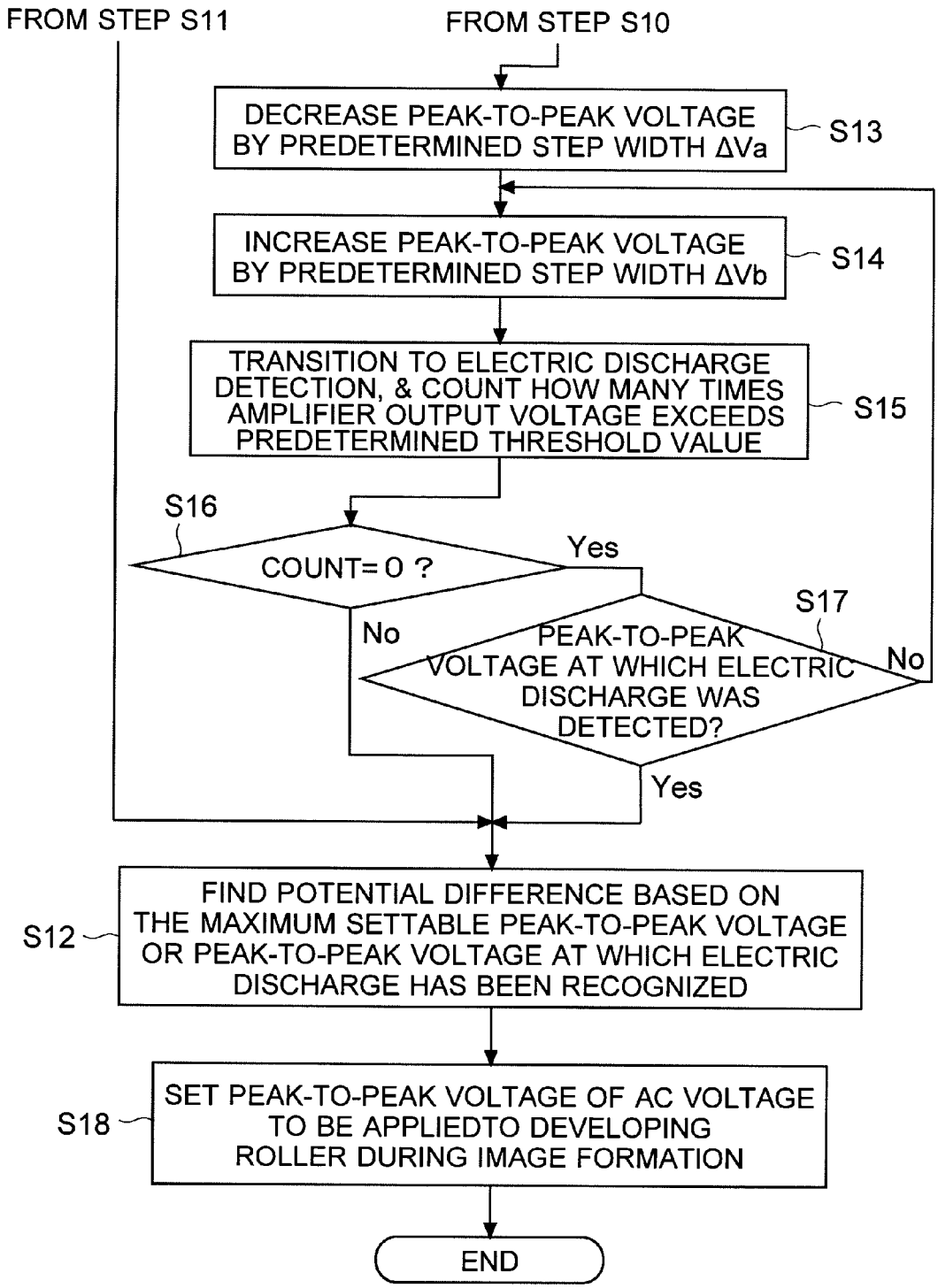
FIG. 10 is a flow chart showing an example of the flow of control for electric discharge detection operation in the printer according to the embodiment.

Next, with reference to FIGS. 9 and 10, an example of the flow of a control sequence for intentionally causing electric discharge and detecting it with a view to grasping the peak-to-peak voltage at which electric discharge starts. FIGS. 9 and 10 are flow charts showing an example of the flow of control for electric discharge detection operation in the printer 1 according to the embodiment of the invention. FIGS. 9 and 10 show, in a form divided into two charts, the control sequence related to electric discharge detection according to the embodiment of the invention. These flow charts show the control for one image formation portion 3, and it is repeated four times when performed for all the colors.

This electric discharge detection can be performed, for example, at the time of manufacture for detection of initial defects or for initial setting, at the time of installation of the printer 1, or at the time of replacement of the developing unit 8 or the photoconductive drum 9. The reason it is performed at the time of installation is that the atmospheric pressure varies with the altitude of the installation environment (e.g., between a lowland area in Japan and a plateau area in Mexico) and this produces a difference in the voltage at which electric discharge occurs. The reason it is performed at the time of replacement of the developing unit 8 etc. is that the gap between the photoconductive drum 9 and the developing roller 81 changes before and after replacement. The examples just mentioned are not meant as any limitation: electric discharge detection may be performed every time the printer 1 has printed a given number of sheets; the timing with which it is performed may be set as desired.

First, when electric discharge detection operation is started through predetermined operation on the operation panel 13 or the like ("START"), under instructions from the CPU 11 (control portion 10), the motor M and the unillustrated drive mechanism set in rotation the various rotating members in the image formation portion 3 and the intermediate transfer portion 5, such as the photoconductive drum 9, the developing roller 81, the magnetic roller 82, and the intermediate transfer belt 52 (step S1). This driving of the rotating members continues until completion of the operation for detecting the peak-to-peak voltage at which electric discharge starts.

Next, the initial operation described with reference to FIG. 5 is performed. In particular, according to the invention, the magnetic roller bias is applied to all the magnetic rollers 82 (step S2). Next, a transition is made to the preparation state described with reference to FIG. 5 (step S3), where, for example under an instruction from the CPU 11, the charge voltage application portion 72 starts to apply a voltage to the charging unit 7.

Here, the reason that the magnetic roller bias is applied to all the magnetic rollers 82 will be described. The printer according to the embodiment has the motor M for driving the photoconductive drum 9 to rotate. In the printer according to the embodiment, when the motor M is driven, the photoconductive drums 9 (of which there are four in total) of all the image formation portions 3 rotate simultaneously. That is, the photoconductive drums 9 in the different image formation portions 3 rotate all in a similar manner. Accordingly, a rise in the toner potential at the tip part of the blade 33 may occur not only in the image formation portion 3 in which electric discharge detection is being performed but in any other image formation portion 3. Accordingly, in the printer according to the embodiment, at the time of electric discharge detection, the magnetic roller bias is applied to all the magnetic rollers 82 with identical timing. Specifically, at the time of electric discharge detection, the detection portion 14 detects electric discharge for the image formation portions 3 one after another sequentially, the individual developing units 8 feed toner to the developing rollers 81 of the respective image formation portions 3 with identical timing, and the individual developing rollers 81 have an AC voltage applied to them with identical timing by the AC voltage application portion 86. The concept of applying the magnetic roller bias in this way is reflected not only at step S2 but also at step S9-1 described later.

Next, the default measurement described with reference to FIG. 5 is performed (step S4). At this time, whether or not electric discharge occurs is checked (step S5). This default measurement is performed in a state in which no electric discharge is supposed to occur; if occurrence of electric discharge is detected in the default measurement ("Yes" at step S5), an abnormality in the gap length or in the detection portion 14 etc. is likely. In that case, an error indication is given on the operation panel 13 or the like (step S6), and electric discharge detection comes to an end ("END").

On the other hand, if no signal indicating occurrence of electric discharge is fed to the CPU 11 ("No" at step S5), a transition is made to the condition change state described with reference to FIG. 5. Then, under an instruction from the CPU 11, the Vpp control portion 88 makes a setting such that the peak-to-peak voltage of the AC voltage that the AC voltage application portion 86 outputs is increased by a predetermined step width ΔVa (e.g., 30 to 100 V) from its current level (step S7).

Next, the control portion (CPU) checks whether or not a predetermined time has elapsed since the previous application of the magnetic roller bias (step S8). If the predetermined time has not elapsed ("No" at step S8), it is recognized that there has been no such rise as to cause electric discharge or the like in the potential of the toner rubbed against the photoconductive drum 9 at the tip part of the blade 33, and thus a transition is made to the discharge detection state. Specifically, the AC voltage application portion 86 applies to the developing roller 81 an AC voltage of which the peak-to-peak voltage has been increased by ΔVa. Moreover, under an instruction form the CPU 11, exposure is performed. Meanwhile, the CPU 11 counts the number of times that the output voltage of the amplifier 15 becomes higher than a predetermined threshold value (step S9-2). Then, a transition is made to step S10.

By contrast, if the predetermined time has elapsed ("Yes" at step S8), the potential of the toner at the tip part of the blade 33 is rising so high as to cause electric discharge or the like. Accordingly, a transition is made to the discharge detection state, where an AC voltage whose peak-to-peak voltage has been increased by ΔVa is applied to the developing roller 81, exposure is performed under an instruction from the CPU 11, the magnetic roller bias is applied to all the magnetic rollers 82, and meanwhile the CPU 11 counts the number of times that the output voltage of the amplifier 15 becomes higher than a predetermined threshold value (step S9-1). That is, at the time of electric discharge detection, the developing unit 8 feeds toner to the developing roller 81 with prescribed timing and for a prescribed time. Specifically, at the time of electric discharge detection, the magnetic roller bias application portion 84 applies a voltage to the magnetic roller 82 with prescribed timing, for a prescribed time.

Through these steps S8 and S9-1, a small amount of toner is temporarily fed to the developing roller 81 and the photoconductive drum 9. Thus, even if electric discharge detection for all the image formation portions 3 lasts long (e.g., several tens of seconds to several minutes), the toner rubbed against the photoconductive drum 9 can be replaced at a given cycle. This eliminates an excessive rise in the potential of the toner at the tip part of the blade 33. Thereafter, a transition is made to step S10.

Then, whether or not the counted number is 0 is checked (step S10). If it is 0 ("Yes" at step S10), it is recognized that no electric discharge occurs, and the CPU 11 checks whether or not the current peak-to-peak voltage has reached the maximum settable value (e.g., 1,500 to 3,000 V) (step S11). If it has ("Yes" at step S11), a transition is made to step S12 (the details will be given later); otherwise ("No" at step S11), a return is made to step S7.

If, at step S10, the counted number is 1 or more ("No" at step S10), it is recognized that electric discharge occurs, and the control portion 10 (CPU 11) feeds an instruction to the Vpp control portion 88. According to the instruction, the Vpp control portion 88 makes a setting such that the peak-to-peak voltage of the AC voltage applied to the developing roller 81 is decreased by the predetermined step width ΔVa from that of the previously applied AC voltage (step S13). Subsequently, the Vpp control portion 88 sets the peak-to-peak voltage of the AC voltage applied to the developing roller 81 at a value increased by a predetermined step width ΔVb (step S14). Here, the predetermined step width ΔVb may be a fraction of the predetermined step width ΔVa (like, e.g., when ΔVa=50 V, ΔVb=10 V). In other words, to more finely detect the peak-to-peak voltage at which electric discharge occurs, a return one step is made and the step width of stepwise varying of the peak-to-peak voltage in electric discharge detection is decreased.

There follows, as at step S9-2, the discharge detection state, where the CPU 11 counts the number of times that the output voltage of the amplifier 15 becomes higher than a predetermined threshold value (step S15). In other words, while the peak-to-peak voltage is varied stepwise in step widths of ΔVa, when electric discharge is detected, to more finely ascertain the peak-to-peak voltage at which electric discharge occurs, the discharge detection state and the condition change state are repeated in step widths of ΔVb until electric discharge is detected.

Next, whether or not the counted number is 0 is checked (step S16). If it is 0 ("Yes" at step S16), the control portion 10 recognizes that no electric discharge occurs, and checks whether or not the current peak-to-peak voltage has reached the peak-to-peak voltage at which electric discharge was previously detected (step S17). If it has ("Yes" at step S17), a transition is made to step S12; otherwise ("No" at step S17), a return is made to step S14. By contrast, if the counted value is 1 or more ("No" at step S16), the CPU 11 recognizes that electric discharge occurs at the current peak-to-peak voltage, and an advance is made to step S12.

Next, step S12 will be described in detail. When electric discharge is detected ("No" at step S16, or "Yes" at step S17), or when no electric discharge is detected at the maximum settable peak-to-peak voltage ("Yes" at step S11), the control portion 10 (CPU 11) finds the potential difference $V_{+2}$ shown in FIG. 6 (the potential difference between the photoconductive drum 9 and the developing roller 81 on detection of electric discharge or on application of Vpp2 at its maximum settable value) based on the maximum peak-to-peak voltage or the peak-to-peak voltage Vpp2 at which electric discharge has been recognized to occur, the frequency f2, the duty ratio D2, and the bias setting value Vdc2.

Here, $V_{+2}$ can be found easily. The CPU 11 specifies the magnitude of the peak-to-peak voltage and feeds an instruction to the Vpp control portion 88. Accordingly, when the control portion 10 detects electric discharge, it grasps Vpp2 at that time. Then, so that the positive- and negative-side areas may be equal with respect to the duty ratio D2 and Vdc2 as set values, the potential difference between the positive-side peak value of Vpp2 and Vdc2 is found. By adding to this potential difference the potential difference between Vdc2 and V0 (since V0 approximately equals 0 V, the latter potential difference can be regarded as Vdc2), $V_{+2}$ can be found.

Specifically, at the time of electric discharge detection, Vpp2 is varied in steps. Assuming that the duty ratio D2 and the bias setting value Vdc2 are constant, for each different magnitude of Vpp2, $V_{+2}$ can be calculated in advance. Values of $V_{+2}$ calculated for different magnitudes of Vpp2 are taken as data in the form of a look-up table. This table may be stored, for example, in the storage portion 12. The CPU 11 may find $V_{+2}$ by referring to the table.

Next, based on the $V_{+2}$ found, the CPU 11 sets the peak-to-peak voltage Vpp1 of the AC voltage applied to the developing roller 81 at the time of printing such that $V_{+1}$ and V_ shown in FIG. 6 are both smaller than the $V_{+2}$ found (step S18). Specifically, Vpp1 may be decided by one of many various methods, and can be found, for example, by calculation. Moreover, consideration needs to be given to circumstances such as the fact that the level by which to make $V_{+1}$ and V__ smaller than $V_{+2}$ (how large a margin to secure) in order to eliminate electric discharge varies according to the toner used, etc. Accordingly, through experiments at the time of product development, for example, for each $V_{+2}$ found, the value of Vpp1 at which no electric discharge is recognized to occur at the time of printing is put in a table. The control portion 10 (CPU 11) may then determine Vpp1 by referring to that table. This table may also be stored in the storage portion 12. This makes it possible to apply, at the time of printing, as high an alternating current as possible that does not cause electric discharge. On completion of the setting of this Vpp1, electric discharge detection and the setting of Vpp1 at the time of printing come to an end.

As described above, the printer according to the embodiment has: a photoconductive drum 9 that is rotatably supported and that rotates by receiving a drive force from a drive source; a developing roller 81 that carries toner to be charged, that is connected to a first voltage application portion (AC voltage application portion 86) outputting an AC voltage, and that feeds toner to the photoconductive drum 9; a contact member (blade 33) that makes contact with the photoconductive drum 9 to remove residual toner; a detection portion 14 that detects occurrence of electric discharge between the developing roller 81 and the photoconductive drum 9; and a developing unit 8 that feeds toner to the developing roller 81, and that supports the developing roller 81 opposite the photoconductive drum 9 with a gap secured in between, the developing unit 8 feeding toner to the developing roller 81 with prescribed timing and for a prescribed time during electric discharge detection in which, while the photoconductive drum 9 rotates and the first voltage application portion (AC voltage application portion 86) stepwise varies a peak-to-peak voltage of an AC voltage applied to the developing roller 81, a voltage at which electric discharge occurs between the photoconductive drum 9 and the developing roller 81 occurs is detected.

At the time of electric discharge detection, the developing unit 8 feeds toner to the developing roller 81 with prescribed timing and for a prescribed time; at the time of electric discharge detection, toner is not carried on the developing roller 81 all the time. This prevents instability of the peak-to-peak voltage at which electric discharge occurs, and erroneous detection of electric discharge due to charged toner moving from the developing roller 81 to the photoconductive drum 9, as would occur if toner were carried on the developing roller 81. Thus, it is possible to accurately detect and measure the voltage (peak-to-peak voltage) at which electric discharge starts between the photoconductive drum 9 and the developing roller 81.

Moreover, at the time of electric discharge detection, even when photoconductive drum 9 continues to rotate, toner is regularly fed to the photoconductive drum 9, and this is scraped off by the contact member (e.g., blade 33). This permits the toner that has been rubbed to be pushed away and replaced with newly fed toner. This helps avoid a friction-induced excessive rise in the potential of the toner between the photoconductive drum 9 and the contact member. Thus, it is possible, at the time of electric discharge detection, to eliminate dielectric breakdown such as electric discharge by toner between the photoconductive drum 9 and the contact member, and damage (such as a pinhole) to the photoconductive drum 9.

The developing unit 8 may have a rotating member (magnetic roller 82) that is disposed opposite the developing roller 81, that is connected to a second voltage application portion (magnetic roller bias application portion 84), and that feeds toner to the developing roller 81 when a voltage is applied from the second voltage application portion. Here, during the electric discharge detection, the developing unit 8 may feed toner to the developing roller 81 with the prescribed timing and for the prescribed time as a result of the second voltage application portion (magnetic roller bias application portion 84) applying the voltage to the rotating member (magnetic roller 82) with prescribed timing and for a prescribed time. With this configuration, at the time of electric discharge detection, the second voltage application portion (magnetic roller bias application portion 84) applies a voltage to the rotating member (magnetic roller 82) with prescribed timing and for a prescribed time, and this permits control of the feeding of toner to the developing roller 81.

The prescribed timing may be when the electric discharge detection is started. With this configuration, when electric discharge detection is started, toner is fed to the developing roller 81 and the photoconductive drum 9. Thus, the toner that has been rubbed against the photoconductive drum 9 at the start of electric discharge detection can be replaced with newly fed toner.

The prescribed timing may be when a predetermined time has elapsed after previous feeding of toner to the developing roller 81 by the developing unit 8. At the time of electric discharge detection, since toner is fed to the developing roller 81 and the photoconductive drum 9, the toner that has been rubbed during electric discharge detection can be regularly replaced with newly fed toner. Thus, it is possible, at the start of and during electric discharge detection, to surely reduce the potential of the toner that attaches to the contact member. This reduces damage to the photoconductive drum 9.

An image formation portion 3 may include at least the photoconductive drum 9, the developing roller 81, the contact member (blade 33), and the developing unit (8), and a plurality of such image formation portions 3 may be provided within the apparatus, the photoconductive drums 9 in the image formation portions 3 (3*a* to 3*d*) all rotating in a similar manner. Here, during the electric discharge detection, detection of electric discharge may be performed in the image formation portions 3 one after another sequentially; the developing units 8 may feed toner to the developing rollers 81 in the image formation portions with identical timing; and the developing rollers 81 may have an AC voltage applied thereto with identical timing by the first voltage application portion (AC voltage application portion 86). In a case where all the photoconductive drums 9 rotate in a similar manner, as in a case where there are provided a plurality of image formation portions 3 each including the developing roller 81, the photoconductive drum 9, etc., where the detection portion 14 performs electric discharge detection in the image formation portion 3 one by one, and in addition where all the photoconductive drums 9 are rotated by a common motor, when all the photoconductive drums 9 rotate in a similar manner, the potential of the toner that attaches to the contact member rises due to friction with the photoconductive drum 9 even in any image formation portion 3 other than the image formation portion 3 in which electric discharge detection is currently performed. According to the embodiment, however, since toner is temporarily fed to all the photoconductive drums 9, the toner that attaches to the contact member (blade 33) can be replaced with newly fed toner. Thus, at the time of electric discharge detection, it is possible, in all the image formation portions 3, to lower the potential of the toner that attaches to the contact member.

The contact member may be a blade that makes contact with the photoconductive drum along an axial direction of the photoconductive drum 9. Thus, even when the blade 33 is used as the contact member, it is possible, at the time of electric discharge detection, to surely lower the potential of the toner that attaches to the contact member.

There may be provided a control portion 10 that recognizes occurrence of electric discharge based on an output of the detection portion 14. Here, when electric discharge is detected to have occurred during the electric discharge detection, the control portion 10 may find a potential difference between the photoconductive drum 9 and the developing roller 81 relative to a peak voltage of the AC voltage that was applied to the developing roller 81 when electric discharge occurred, and determine an AC voltage to be applied to the photoconductive drum 9 during image formation such that a potential difference between surface potentials of the developing roller 81 and the photoconductive drum 9 during image formation is smaller than the potential difference. Thus, based on the correctly grasped potential difference between the developing roller 81 and the photoconductive drum 9 resulting in occurrence of electric discharge, it is possible to properly set an AC voltage that leads to increased development efficiency and no electric discharge occurs during image formation.

Next, another embodiment will be described. The embodiment described above deals with an example where, first, primary transfer is performed from the photoconductive drum 9 onto the intermediate transfer belt 52 and, then, secondary transfer is performed onto a sheet. The invention can be applied, however, also in a construction in which toner images are directly transferred from the individual photoconductive drums 9 to a sheet (e.g., a construction in which a transfer roller makes direct contact with each photoconductive drum 9 and a sheet passes through the nip between them, a construction in which a transport belt makes contact with each photoconductive drum 9 and a sheet is placed on a transport belt so that the sheet passes through the nip between them, etc.).

Although the embodiment described above deals with a case where the photoconductive drum 9 and the toner are of a positive-charging type, the invention can be applied also in a case where a photoconductive drum 9 and toner of a negative-charging type are used. Although the embodiment described above deals with a color image forming apparatus, the invention can be applied to a monochrome image forming apparatus having, for example, a image formation portion 3*a* (black) alone.

It should be understood that the embodiments of the invention described above are not meant to limit the scope of the invention in any way and may be implemented with many variations and modifications made within the spirit of the invention.

What is claimed is:

1. An image forming apparatus comprising:

a photoconductive drum
rotatably supported, and
rotating by receiving a drive force from a drive source;

a first voltage application portion outputting an AC voltage;

a developing roller
carrying toner to be charged,
connected to the first voltage application portion, and
feeding toner to the photoconductive drum;

a contact member making contact with the photoconductive drum to remove residual toner;

a detection portion detecting occurrence of electric discharge between the developing roller and the photoconductive drum; and a developing unit
feeding toner to the developing roller, and
supporting the developing roller opposite the photoconductive drum with a gap secured in between,
the developing unit feeding toner to the developing roller with prescribed timing and for a prescribed time during electric discharge detection in which, while the photoconductive drum rotates and the first voltage application portion stepwise varies a peak-to-peak voltage of an AC voltage applied to the developing roller, a voltage at which electric discharge occurs between the photoconductive drum and the developing roller is detected.

2. The image forming apparatus according to claim 1, wherein the developing unit comprises a rotating member opposite the developing roller,
connected to a second voltage application portion, and
feeding toner to the developing roller when a voltage is applied from the second voltage application portion, and during the electric discharge detection, the developing unit feeds toner to the developing roller with the prescribed timing and for the prescribed time as a result of the second voltage application portion applying the voltage to the rotating member with prescribed timing and for a prescribed time.

3. The image forming apparatus according to claim 2, wherein the prescribed timing is when the electric discharge detection is started.

4. The image forming apparatus according to claim 2, wherein the prescribed timing is when a predetermined time has elapsed after previous feeding of toner to the developing roller by the developing unit.

5. The image forming apparatus according to claim 1, wherein the prescribed timing is when the electric discharge detection is started.

6. The image forming apparatus according to claim 1, wherein the prescribed timing is when a predetermined time has elapsed after previous feeding of toner to the developing roller by the developing unit.

7. The image forming apparatus according to claim 1, wherein an image formation portion comprises at least the photoconductive drum, the developing roller, the contact member, and the developing unit, a plurality of such image formation portions are provided within the apparatus, the photoconductive drums in the image formation portions all rotating in a similar manner, during the electric discharge detection, detection of electric discharge is performed in the image formation portions one after another sequentially, the developing units feed toner to the developing rollers in the image formation portions with identical timing, and the developing rollers have an AC voltage applied thereto with identical timing by the first voltage application portion.

8. The image forming apparatus according to claim 1, wherein the contact member is a blade making contact with the photoconductive drum along an axial direction of the photoconductive drum.

9. The image forming apparatus according to claim 1, further comprising:

a control portion recognizing occurrence of electric discharge based on an output of the detection portion, wherein, when electric discharge is detected to have occurred during the electric discharge detection, the control portion finds a potential difference between the photoconductive drum and the developing roller relative to a peak voltage of the AC voltage that was applied to the developing roller when electric discharge occurred, and determines an AC voltage to be applied to the photoconductive drum during image formation such that a potential difference between surface potentials of the developing roller and the photoconductive drum during image formation is smaller than the potential difference at which electric discharge occurred.

10. A method for controlling an image forming apparatus, comprising:

a step of rotating a photoconductive drum that is rotatably supported, that rotates by receiving a drive force from a drive source, and that is provided with a contact member making contact with the photoconductive drum to remove residual toner;

a step in which a first voltage application portion outputting an AC voltage applies the AC voltage, while stepwise varying a peak-to-peak voltage of the AC voltage, to a developing roller that carries toner to be charged and that feeds toner to the photoconductive drum, to make a detection portion detect occurrence of electric discharge between the developing roller and the photoconductive drum, in order to detect a voltage at which electric discharge occurs between the photoconductive drum and the developing roller; and a step of feeding toner to the developing roller and making a developing unit supporting the developing roller opposite the photoconductive drum with a gap secured in between feed toner to the developing roller with prescribed timing and for a prescribed time.

11. The method for controlling an image forming apparatus according to claim 10, further comprising:

a step in which a second voltage application portion, connected to a rotating member that is disposed opposite the developing roller and that feeds toner to the developing roller when a voltage is applied, applies the voltage to the rotating member with prescribed timing and for a prescribed time; and a step in which the developing unit feeds toner to the developing roller with the prescribed timing and for the prescribed time.

12. The method for controlling an image forming apparatus according to claim 11, wherein the prescribed timing is when the electric discharge detection is started.

13. The method for controlling an image forming apparatus according to claim 11, wherein the prescribed timing is when a predetermined time has elapsed after previous feeding of toner to the developing roller by the developing unit.

14. The method for controlling an image forming apparatus according to claim 10, wherein the prescribed timing is when the electric discharge detection is started.

15. The method for controlling an image forming apparatus according to claim 10, wherein the prescribed timing is when a predetermined time has elapsed after previous feeding of toner to the developing roller by the developing unit.

16. The method for controlling an image forming apparatus according to claim 10, wherein a plurality of image formation portions each comprising at least the photoconductive drum, the developing roller, the contact member, and the developing unit are provided within the apparatus, the photoconductive drums in the image formation portions all rotating in a similar manner, and the method further comprises:

a step of performing detection of electric discharge in the image formation portions one after another sequentially;

a step in which the developing units feed toner to the developing rollers in the image formation portions with identical timing; and a step in which the first voltage application portion applies an AC voltage to the developing rollers with identical timing.

17. The method for controlling an image forming apparatus according to claim 10, wherein the contact member is a blade making contact with the photoconductive drum along an axial direction of the photoconductive drum.

18. The method for controlling an image forming apparatus according to claim 10, further comprising:

when electric discharge is detected to have occurred during the electric discharge detection, a step in which a control portion recognizing occurrence of electric discharge based on an output of the detection portion finds a potential difference between the photoconductive drum and the developing roller relative to a peak voltage of the AC voltage that was applied to the developing roller when electric discharge occurred; and a step of determining an AC voltage to be applied to the photoconductive drum during image formation such that a potential difference between surface potentials of the developing roller and the photoconductive drum during image formation is smaller than the potential difference at which electric discharge occurred.

* * * * *